US012063953B2

(12) United States Patent
Zawadzki et al.

(10) Patent No.: US 12,063,953 B2
(45) Date of Patent: Aug. 20, 2024

(54) METHOD FOR WHITENING TOBACCO

(71) Applicant: Nicoventures Trading Limited, London (GB)

(72) Inventors: Michael Andrew Zawadzki, Clemmons, NC (US); David Neil McClanahan, Winston-Salem, NC (US)

(73) Assignee: Nicoventures Trading Limited, London (GB)

( * ) Notice: Subject to any disclaimer, the term of this patent is extended or adjusted under 35 U.S.C. 154(b) by 303 days.

(21) Appl. No.: 16/567,822

(22) Filed: Sep. 11, 2019

(65) Prior Publication Data

US 2021/0068448 A1 Mar. 11, 2021

(51) Int. Cl.

| | |
|---|---|
| ***A24B 15/42*** | (2006.01) |
| ***A24B 13/00*** | (2006.01) |
| ***A24B 15/26*** | (2006.01) |
| ***A24F 23/02*** | (2006.01) |

(52) U.S. Cl.
CPC ..... *A24B 15/42* (2013.01); *A24B 13/00* (2013.01); *A24B 15/26* (2013.01); *A24F 23/02* (2013.01)

(58) Field of Classification Search
CPC ..... A24B 15/42; A24B 15/26; A24F 23/02
See application file for complete search history.

(56) References Cited

U.S. PATENT DOCUMENTS

| | | | |
|---|---|---|---|
| 787,611 | A | 4/1905 | Daniels, Jr. |
| 1,086,306 | A | 2/1914 | Oelenheinz |
| 1,437,095 | A | 11/1922 | Delling |
| 1,757,477 | A | 5/1930 | Rosenhoch |
| 1,847,162 | A | 3/1932 | Andrews |
| 2,122,421 | A | 7/1938 | Hawkinson |
| 2,131,160 | A | 9/1938 | Avedikian |

(Continued)

FOREIGN PATENT DOCUMENTS

| | | |
|---|---|---|
| BR | PI1106360 | 11/2013 |
| CA | 2183825 | 2/1997 |

(Continued)

OTHER PUBLICATIONS

Huang, C. et al., "Production of Dissolving Grade Pulp from Tobacco Stalk Through SO2-ethanol-water Fractionation, Alkaline Extraction, and Bleaching Processes," *BioResources*, 2019, vol. 14(3), pp. 5544-5558.

(Continued)

*Primary Examiner* — Christopher M Rodd
*Assistant Examiner* — Jennifer A Kessie
(74) *Attorney, Agent, or Firm* — WOMBLE BOND DICKINSON (US) LLP

(57) ABSTRACT

A method of preparing a whitened tobacco material for use in a smokeless tobacco product, including: (i) extracting a tobacco material with an aqueous solution to provide a tobacco solids material and a tobacco extract; (ii) bleaching the tobacco solids material with a solution comprising a strong base, an oxidizing agent, or a combination thereof to provide a bleached tobacco material; and (iii) drying the bleached tobacco material to provide the whitened tobacco material; wherein the tobacco solids material is not subjected to treatment at an elevated temperature with sulfur-containing reagents, organic solvents, sodium hydroxide, or an acid between the extraction and the bleaching.

23 Claims, 2 Drawing Sheets

(56) References Cited

U.S. PATENT DOCUMENTS

| | | | |
|---|---|---|---|
| 2,148,147 | A | 2/1939 | Baier |
| 2,170,107 | A | 8/1939 | Baier |
| 2,274,649 | A | 3/1942 | Baier |
| 2,770,239 | A | 11/1956 | Prats et al. |
| 3,020,179 | A | 2/1962 | Hess |
| 3,361,139 | A | 1/1968 | Inoue |
| 3,612,065 | A | 10/1971 | Rosen |
| 3,851,653 | A | 12/1974 | Rosen |
| 3,889,689 | A | 6/1975 | Rosen |
| 3,943,940 | A | 3/1976 | Minami |
| 3,943,945 | A | 3/1976 | Rosen |
| 4,143,666 | A | 3/1979 | Rainer et al. |
| 4,144,895 | A | 3/1979 | Fiore |
| 4,150,677 | A | 4/1979 | Osborne, Jr. et al. |
| 4,194,514 | A | 3/1980 | Campbell |
| 4,267,847 | A | 5/1981 | Reid |
| 4,289,147 | A | 9/1981 | Wildman et al. |
| 4,343,317 | A | 8/1982 | Bokelman |
| 4,351,346 | A | 9/1982 | Brummer et al. |
| 4,355,648 | A | 10/1982 | Bokelman et al. |
| 4,359,059 | A | 11/1982 | Brummer et al. |
| 4,362,170 | A | 12/1982 | Keritsis et al. |
| 4,366,823 | A | 1/1983 | Rainer et al. |
| 4,366,824 | A | 1/1983 | Rainer et al. |
| 4,388,933 | A | 6/1983 | Rainer et al. |
| 4,506,682 | A | 3/1985 | Muller |
| 4,589,428 | A | 5/1986 | Keritsis |
| 4,605,016 | A | 8/1986 | Soga et al. |
| 4,612,942 | A | 9/1986 | Dobberstein et al. |
| 4,641,667 | A | 2/1987 | Schmekel et al. |
| 4,716,911 | A | 1/1988 | Poulose et al. |
| 4,727,888 | A | 3/1988 | Luke |
| 4,727,889 | A | 3/1988 | Niven, Jr. et al. |
| 4,882,128 | A | 11/1989 | Hukvari et al. |
| 4,887,618 | A | 12/1989 | Bernasek et al. |
| 4,941,484 | A | 7/1990 | Clapp et al. |
| 4,967,771 | A | 11/1990 | Fagg et al. |
| 4,986,286 | A | 1/1991 | Roberts et al. |
| 5,005,593 | A | 4/1991 | Fagg |
| 5,018,540 | A | 5/1991 | Grubbs et al. |
| 5,060,669 | A | 10/1991 | White et al. |
| 5,065,775 | A | 11/1991 | Fagg |
| 5,074,319 | A | 12/1991 | White et al. |
| 5,099,862 | A | 3/1992 | White et al. |
| 5,121,757 | A | 6/1992 | White et al. |
| 5,131,414 | A | 7/1992 | Fagg et al. |
| 5,131,415 | A | 7/1992 | Munoz et al. |
| 5,148,819 | A | 9/1992 | Fagg |
| 5,197,494 | A | 3/1993 | Kramer |
| 5,219,660 | A | 6/1993 | Wason et al. |
| 5,230,354 | A | 7/1993 | Smith et al. |
| 5,234,008 | A | 8/1993 | Fagg |
| 5,243,999 | A | 9/1993 | Smith |
| 5,301,694 | A | 4/1994 | Raymond et al. |
| 5,318,050 | A | 6/1994 | Gonzalez-Parra et al. |
| 5,343,879 | A | 9/1994 | Teague |
| 5,360,022 | A | 11/1994 | Newton et al. |
| 5,435,325 | A | 7/1995 | Clapp et al. |
| 5,445,169 | A | 8/1995 | Brinkley et al. |
| 5,713,376 | A | 2/1998 | Berger |
| 5,770,011 | A | 6/1998 | Lam et al. |
| 5,810,020 | A | 9/1998 | Northway et al. |
| 6,058,940 | A | 5/2000 | Lane |
| 6,131,584 | A | 10/2000 | Lauterbach |
| 6,214,164 | B1 | 4/2001 | Rantala |
| 6,221,209 | B1 | 4/2001 | Desprez et al. |
| 6,298,859 | B1 | 10/2001 | Kierulff et al. |
| 6,679,270 | B2 | 1/2004 | Baskevitch et al. |
| 6,772,767 | B2 | 8/2004 | Mua et al. |
| 7,337,782 | B2 | 3/2008 | Thompson |
| 7,677,253 | B2 | 3/2010 | Yamada et al. |
| 7,861,728 | B2 | 1/2011 | Holton, Jr. et al. |
| 8,695,609 | B2 | 4/2014 | Dube et al. |
| 8,991,403 | B2 | 3/2015 | Chen et al. |
| 9,321,806 | B2 | 4/2016 | Lo et al. |
| 9,339,058 | B2 | 5/2016 | Byrd, Jr. et al. |
| 9,420,825 | B2 | 8/2016 | Beeson et al. |
| 9,950,858 | B2 | 4/2018 | Byrd, Jr. et al. |
| 10,772,349 | B2 | 9/2020 | Beeson et al. |
| 2002/0134394 | A1 | 9/2002 | Baskevitch et al. |
| 2005/0034737 | A1 | 2/2005 | Kunz et al. |
| 2005/0056294 | A1 | 3/2005 | Wanna et al. |
| 2005/0241657 | A1 | 11/2005 | Mua et al. |
| 2006/0021626 | A1 | 2/2006 | Mua |
| 2006/0191548 | A1 | 8/2006 | Strickland et al. |
| 2007/0062549 | A1 | 3/2007 | Holton et al. |
| 2007/0186941 | A1 | 8/2007 | Holton, Jr. et al. |
| 2008/0029110 | A1 | 2/2008 | Dube et al. |
| 2008/0178894 | A1* | 7/2008 | Zimmermann ..... A24B 15/24 131/297 |
| 2009/0025738 | A1 | 1/2009 | Mua et al. |
| 2009/0126747 | A1 | 5/2009 | L'Heureux et al. |
| 2009/0293889 | A1 | 12/2009 | Kumar et al. |
| 2010/0126520 | A1 | 5/2010 | Clayton |
| 2010/0294292 | A1 | 11/2010 | Hodin et al. |
| 2010/0300463 | A1 | 12/2010 | Chen et al. |
| 2011/0048434 | A1 | 3/2011 | Chen et al. |
| 2011/0083683 | A1 | 4/2011 | Krauss |
| 2011/0247640 | A1 | 10/2011 | Beeson et al. |
| 2011/0315154 | A1 | 12/2011 | Mua et al. |
| 2012/0067361 | A1 | 3/2012 | Björkholm et al. |
| 2012/0152265 | A1 | 6/2012 | Dube et al. |
| 2012/0192880 | A1 | 8/2012 | Dube et al. |
| 2013/0206153 | A1 | 8/2013 | Beeson et al. |
| 2013/0251779 | A1 | 9/2013 | Svandal et al. |
| 2013/0276801 | A1 | 10/2013 | Byrd, Jr. et al. |
| 2014/0190497 | A1 | 7/2014 | Dube et al. |
| 2015/0305399 | A1 | 10/2015 | Kotrola et al. |
| 2016/0073686 | A1 | 3/2016 | Crooks |
| 2017/0020183 | A1 | 1/2017 | Björkholm |
| 2017/0112183 | A1 | 4/2017 | Björkholm |
| 2018/0266053 | A1 | 9/2018 | Sebastian et al. |
| 2020/0196658 | A1 | 6/2020 | McClanahan et al. |

FOREIGN PATENT DOCUMENTS

| | | |
|---|---|---|
| CN | 1477935 | 2/2004 |
| CN | 101642286 | 2/2010 |
| CN | 102943408 | 2/2013 |
| CN | 105725255 | 7/2016 |
| CN | 104532662 | 2/2017 |
| CN | 106942783 | 7/2017 |
| DE | 467964 | 11/1928 |
| DE | 635840 | 12/1936 |
| DE | 662320 | 7/1938 |
| DE | 671126 | 1/1939 |
| DE | 686442 | 1/1940 |
| DE | 3736335 | 5/1989 |
| DE | 29506564 | 6/1995 |
| EP | 3491940 | 6/2019 |
| FR | 379963 | 11/1907 |
| GB | 190312646 | 8/1903 |
| GB | 832991 | 4/1960 |
| GB | 884435 | 12/1961 |
| GB | 2 113 065 | 8/1983 |
| NL | 7810833 | 5/1980 |
| WO | WO 96/31255 | 10/1996 |
| WO | WO 97/19222 | 5/1997 |
| WO | WO 97/28305 | 8/1997 |
| WO | WO 2009/068279 | 6/2009 |
| WO | WO 2015/167430 | 11/2015 |
| WO | WO 2016/067226 | 5/2016 |
| WO | WO 2018/083114 | 5/2018 |

OTHER PUBLICATIONS

Li, Z. et al., "Hot Water Extraction of Hemicelluloses from Aspen Wood Chips of Different Sizes," *BioResources*, 2013, vol. 8(4), pp. 5690-5700.

Sun, X. et al., "Iso-concentration hydrogen peroxide bleaching of poplar chemi-thermomechanical pulp," *Journal of Bioresources and Bioproducts*, 2018, vol. 3(1), pp. 35-39.

(56) References Cited

OTHER PUBLICATIONS

Zhao, Q. et al., "Process Optimization of Tetra Acetyl Ethylene Diamine Activated Hydrogen Peroxide Bleaching of *Populus Nigra* CTMP," *BioResources*, 2010, vol. 5(1), pp. 276-290.
Zou, Y. et al., "TAED Activator for Peroxide Bleaching of Recycled Pulp," 2007, URL: https://www.tappi.org/content/events/07recycle/presentation/hsieh.pdf.
AZoM, Particle Size—US Sieve Series and Tyler Mesh Size Equivalents, May 15, 2002, https://www.azom.com/article.aspx?ArticleID=1417 (Year: 2002).
Barros, et al., "*Effect of Last Stage Bleaching With Peracetic Acid on Brightness Development and Properties of Eucalyptus Pulp*;" BioResources, vol. 5, No. 2 (2010), pp. 881-898.
Borrega, "*Hot Water Treatment of Hardwood Kraft Pulp Produces High-Purity Cellulose and Polymeric Xylan*;" Cellulose 24 (2017): 5133-5145.
Borrega, et al., "*Purification of Cellulosic Pulp by Hot Water Extraction*;" Cellulose 20.6 (2013): 2803-2812.
Zhao, et al., "Single-Stage Pulping of Sugarcane Bagasse with Peracetic Acid," *Journal of Wood Chemistry and Technology*, 2011, vol. 31, No. 1, pp. 1-25.

* cited by examiner

METHOD FOR WHITENING TOBACCO

FIELD OF THE INVENTION

The present invention relates to products made or derived from tobacco, or that otherwise incorporate tobacco, and are intended for human consumption.

BACKGROUND

Cigarettes, cigars and pipes are popular smoking articles that employ tobacco in various forms. Such smoking articles are used by heating or burning tobacco, and aerosol (e.g., smoke) is inhaled by the smoker. Tobacco may be enjoyed in a so-called "smokeless" form. Particularly popular smokeless tobacco products are employed by inserting some form of processed tobacco or tobacco-containing formulation into the mouth of the user.

Conventional formats for such smokeless tobacco products include moist snuff, snus, and chewing tobacco, which are typically formed almost entirely of particulate, granular, or shredded tobacco, and which are either portioned by the user or presented to the user in individual portions, such as in single-use pouches or sachets. Other traditional forms of smokeless products include compressed or agglomerated forms, such as plugs, tablets, or pellets. Alternative product formats, such as tobacco-containing gums and mixtures of tobacco with other plant materials, are also known. See for example, the types of smokeless tobacco formulations, ingredients, and processing methodologies set forth in U.S. Pat. No. 1,376,586 to Schwartz; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,991,599 to Tibbetts; U.S. Pat. No. 4,987,907 to Townsend; U.S. Pat. No. 5,092,352 to Sprinkle, III et al.; U.S. Pat. No. 5,387,416 to White et al.; U.S. Pat. No. 6,668,839 to Williams; U.S. Pat. No. 6,834,654 to Williams; U.S. Pat. No. 6,953,040 to Atchley et al.; U.S. Pat. No. 7,032,601 to Atchley et al.; and U.S. Pat. No. 7,694,686 to Atchley et al.; US Pat. Pub. Nos. 2004/0020503 to Williams; 2005/0115580 to Quinter et al.; 2006/0191548 to Strickland et al.; 2007/0062549 to Holton, Jr. et al.; 2007/0186941 to Holton, Jr. et al.; 2007/0186942 to Strickland et al.; 2008/0029110 to Dube et al.; 2008/0029116 to Robinson et al.; 2008/0173317 to Robinson et al.; 2008/0209586 to Neilsen et al.; 2009/0065013 to Essen et al.; and 2010/0282267 to Atchley, as well as WO2004/095959 to Arnarp et al., each of which is incorporated herein by reference.

Smokeless tobacco product configurations that combine tobacco material with various binders and fillers have been proposed more recently, with example product formats including lozenges, pastilles, gels, extruded forms, and the like. See, for example, the types of products described in US Patent App. Pub. Nos. 2008/0196730 to Engstrom et al.; 2008/0305216 to Crawford et al.; 2009/0293889 to Kumar et al.; 2010/0291245 to Gao et al; 2011/0139164 to Mua et al.; 2012/0037175 to Cantrell et al.; 2012/0055494 to Hunt et al.; 2012/0138073 to Cantrell et al.; 2012/0138074 to Cantrell et al.; 2013/0074855 to Holton, Jr.; 2013/0074856 to Holton, Jr.; 2013/0152953 to Mua et al.; 2013/0274296 to Jackson et al.; 2015/0068545 to Moldoveanu et al.; 2015/0101627 to Marshall et al.; and 2015/0230515 to Lampe et al., each of which is incorporated herein by reference. Additionally, all-white snus portions are growing in popularity, and offer a discrete and aesthetically pleasing alternative to traditional snus. Such modern "white" pouched products may include a bleached tobacco or may be tobacco-free.

Through the years, various treatment methods and additives have been proposed for altering the overall character or nature of tobacco materials utilized in tobacco compositions. For example, additives or treatment processes are sometimes utilized in order to alter the chemistry or sensory properties of the tobacco material, or in the case of smokable tobacco materials, to alter the chemistry or sensory properties of mainstream smoke generated by smoking articles including the tobacco material. In some cases, a heat treatment process can be used to impart a desired color or visual character to the tobacco material, desired sensory properties to the tobacco material, or a desired physical nature or texture to the tobacco material.

It would be desirable in the art to provide further methods for altering the character and nature of tobacco (and tobacco compositions and formulations) useful in smoking articles or smokeless tobacco products. In particular, an improved tobacco whitening process and whitened tobacco material is desirable, wherein the tobacco whitening process does not include chemical pulping or alkaline extraction prior to the tobacco material bleaching operation.

BRIEF SUMMARY

The present disclosure provides a method of processing a tobacco material to modify the color of the tobacco material, specifically to provide a tobacco material that is lightened in color (i.e., "whitened"). The whitened tobacco material can be used in smokeless tobacco materials to give materials adapted for oral use with a whitened appearance. It has been surprisingly discovered that a high degree of bleaching can be obtained without a harsh chemical pulping step prior to bleaching such as treatment at an elevated temperature with sulfur-containing reagents, organic solvents, sodium hydroxide, or an acid.

In various embodiments, a method for whitening a tobacco material is provided, the method comprising (i) extracting a tobacco material with an extraction solution to provide a tobacco solids material and a tobacco extract; (ii) bleaching the tobacco solids material with a bleaching solution comprising a strong base, an oxidizing agent, or a combination thereof to provide a bleached tobacco material; and (iii) drying the bleached tobacco material to provide the whitened tobacco material; wherein the tobacco solids material is not subjected to treatment at an elevated temperature with sulfur-containing reagents, organic solvents, sodium hydroxide, or an acid between the extracting step (i) and the bleaching step (ii). In various embodiments, the whitened tobacco material is characterized by an International Organization for Standardization (ISO) brightness of at least about 50%. The whitened tobacco materials provided herein can be used in a smokeless tobacco product, for example.

In various embodiments, the starting tobacco material comprises lamina, stems, or a combination thereof. In certain embodiments, the tobacco material comprises *Rustica* stems. In some embodiments, the tobacco material comprises at least about 90% by weight roots, stalks, or a combination thereof. In some embodiments, the whitening method further includes milling the tobacco material prior to extraction such that the milled tobacco material is able to pass through a screen of 18 U.S. sieve size. In certain embodiments, the tobacco material can be milled to a size in the range of 0.2 mm to about 2 mm prior to extraction.

In various embodiments, the extraction solution is an aqueous solution. In some embodiments, the extract solution may acidic, basic, or neutral. The extraction solution may also include metal chelating agents and/or oxidizing agents. For example, in certain embodiments, the aqueous solution comprises one or more of EDTA and DTPA. In certain embodiments, the extraction solution is acidic with a pH less than about 7 and incorporates a metal chelating agent such as ethylenediaminetetraacetic acid (EDTA). In some embodiments, the step of extracting the tobacco material is done at a temperature of about 100° C. or below. In various embodiments, the molar ratio of the extraction solution to the tobacco material in the extraction step is from about 4:1 to about 16:1. In certain embodiments, the whitening method can further comprise mixing the tobacco solids material with a wood pulp prior to bleaching.

In various embodiments, the bleaching step can include treatment with a solution of a strong base and an oxidizing agent or combinations of oxidizing agents. In various embodiments, the bleaching solution comprises one or more of peracetic acid, sodium hydroxide, and hydrogen peroxide. In some embodiments, the bleaching solution comprises a strong base and an oxidizing agent, wherein the weight ratio of the amount of oxidizing agent to the amount of strong base is from about 1:1 to about 100:1. In certain embodiments, the weight ratio of the amount of oxidizing agent to the amount of strong base is from about 2.5:1 to about 15:1. In various embodiments, the step of bleaching the tobacco solids material is done at a temperature of about 100° C. or below. In various embodiments, the whitening method further comprises neutralizing the bleached tobacco material to a pH in the range of about 5 to about 11 prior to drying.

In some embodiments, the bleaching solution further comprises one or more stabilizers in addition to an oxidizing agent. The stabilizers can be selected from the group consisting of magnesium sulfate, sodium silicate, and combinations thereof, for example.

In various embodiments, the bleaching solution used to bleach the tobacco solids material comprises a chelating agent. In certain embodiments, the chelating agent comprises one or more of EDTA and DTPA.

The bleaching solution may also incorporate oxidizer stabilizing agents and metal chelating agents. In certain embodiments, the bleaching solution comprises hydrogen peroxide, and strong base, a metal chelating agent such as ethylenediaminetetraacetic acid (EDTA), and an oxidant stabilizer such as sodium silicate and/or magnesium salts such as magnesium sulfate.

The bleached tobacco material can be dried to a moisture content of less than about 30 percent moisture on a wet basis, for example. In various embodiments, the whitening methods described herein further include dewatering the tobacco material using at least one of a screw press and a basket centrifuge following step (i) (the extraction step) and/or step (ii) (the bleaching step). The whitening method can further include milling the whitened tobacco material following drying to a size in the range of approximately 5 mm to about 0.1 mm.

In various embodiments, the whitening method further comprises incorporating the whitened tobacco material within a smokeless tobacco product. The smokeless tobacco product can further comprise, for example, one or more additional components selected from the group consisting of flavorants, fillers, binders, pH adjusters, buffering agents, colorants, disintegration aids, antioxidants, humectants, and preservatives.

A smokeless tobacco product incorporating the whitened tobacco material prepared according to the methods disclosed herein is also provided. In certain embodiments, the smokeless tobacco product comprises a water-permeable pouch containing the whitened tobacco material. The smokeless tobacco product can further include, for example, one or more additional components selected from the group consisting of flavorants, fillers, binders, pH adjusters, buffering agents, colorants, disintegration aids, antioxidants, humectants, and preservatives.

A method of preparing a whitened tobacco material for use in a smokeless tobacco product is also provided herein, wherein the method consists essentially of or consists of: (i) extracting a tobacco material with an extraction solution to provide a tobacco solids material and a tobacco extract; (ii) separating the tobacco solids material and the tobacco extract; (iii) bleaching the tobacco solids material with a solution comprising a strong base, an oxidizing agent, or a combination thereof to provide a bleached tobacco material; and (iv) drying the bleached tobacco material to provide the whitened tobacco material. The method can optionally include one or more of the following process steps: (i) milling the tobacco material such that the milled tobacco material is able to pass through a screen of 18 U.S. sieve size; (ii) dewatering the tobacco material using at least one of a screw press and a basket centrifuge following the extraction step and/or the bleaching step; (iii) neutralizing the bleached tobacco material to a pH in the range of about 5 to about 11 prior to drying; and (iv) milling the whitened tobacco material following drying to a size in the range of approximately 5 mm to about 0.1 mm. In various embodiments, the extraction solution is an aqueous solution.

The invention includes, without limitation, the following embodiments.

Embodiment 1: A method of preparing a whitened tobacco material, comprising: (i) extracting a tobacco material with an extraction solution to provide a tobacco solids material and a tobacco extract; (ii) bleaching the tobacco solids material with a bleaching solution comprising a strong base, an oxidizing agent, or a combination thereof to provide a bleached tobacco material; and (iii) drying the bleached tobacco material to provide the whitened tobacco material; wherein the tobacco solids material is not subjected to treatment at an elevated temperature with sulfur-containing reagents, organic solvents, sodium hydroxide, or an acid between the extracting of the tobacco material and the bleaching of the tobacco solids material.

Embodiment 2: A method of any preceding embodiment, further comprising milling the tobacco material to a size in the range of approximately 0.2 mm to about 2 mm.

Embodiment 3: A method of any preceding embodiment, wherein the extracting of the tobacco material is done at a temperature of about 100° C. or below.

Embodiment 4: A method of any preceding embodiment, wherein the bleaching of the tobacco solids material is done at a temperature of about 100° C. or below.

Embodiment 5: A method of any preceding embodiment, wherein the bleached tobacco material is dried to a moisture content of less than about 30 percent moisture on a wet basis.

Embodiment 6: A method of any preceding embodiment, further comprising dewatering the tobacco material using at least one of a screw press and a basket centrifuge following extracting the tobacco material and/or bleaching the tobacco solids material.

Embodiment 7: A method of any preceding embodiment, wherein the bleaching solution comprises one or more of peracetic acid, sodium hydroxide, and hydrogen peroxide.

Embodiment 8: A method of any preceding embodiment, wherein the bleaching solution further comprises one or more stabilizers in addition to an oxidizing agent.

Embodiment 9: A method of any preceding embodiment, wherein the bleaching solution further comprises one or more stabilizers, and wherein the stabilizers are selected from the group consisting of magnesium sulfate, sodium silicate, and combinations thereof.

Embodiment 10: A method of any preceding embodiment, wherein the bleaching solution comprises a strong base and an oxidizing agent, and wherein the molar ratio of the amount of oxidizing agent to the amount of strong base is from about 1:1 to about 100:1.

Embodiment 11: A method of any preceding embodiment, wherein the bleaching solution comprises a strong base and an oxidizing agent, and wherein the weight ratio of the amount of oxidizing agent to the amount of strong base is from about 2.5:1 to about 15:1.

Embodiment 12: A method of any preceding embodiment, further comprising neutralizing the bleached tobacco material to a pH in the range of about 5 to about 11 prior to drying the bleached tobacco material.

Embodiment 13: A method of any preceding embodiment, further comprising milling the whitened tobacco material following the drying of the whitened tobacco material to a size in the range of approximately 5 mm to about 0.1 mm.

Embodiment 14: A method of any preceding embodiment, wherein the extraction solution comprises a chelating agent.

Embodiment 15: A method of any preceding embodiment, wherein the extraction solution comprises a chelating agent, and wherein the chelating agent comprises one or more of EDTA and DTPA.

Embodiment 16: A method of any preceding embodiment, wherein the bleaching solution used to bleach the tobacco solids material comprises a chelating agent.

Embodiment 17: A method of any preceding embodiment, wherein the bleaching solution used to bleach the tobacco solids material comprises a chelating agent, and wherein the chelating agent comprises one or more of EDTA and DTPA.

Embodiment 18: A method of any preceding embodiment, wherein the molar ratio of the extraction solution to the tobacco material is from about 4:1 to about 16:1.

Embodiment 19: A method of any preceding embodiment, wherein the extraction solution is an aqueous solution.

Embodiment 20: A method of any preceding embodiment, wherein the tobacco material comprises lamina, stems, or a combination thereof.

Embodiment 21: A method of any preceding embodiment, wherein the tobacco material comprises *Rustica* stems.

Embodiment 22: A method of any preceding embodiment, wherein the tobacco material comprises at least about 90% by weight roots, stalks, or a combination thereof.

Embodiment 23: A method of any preceding embodiment, wherein the whitened tobacco material is characterized by an International Organization for Standardization (ISO) brightness of at least about 50%.

Embodiment 24: A method of any preceding embodiment, further comprising mixing the tobacco solids material with a wood pulp prior to bleaching the tobacco solids material.

Embodiment 25: A method of any preceding embodiment, further comprising incorporating the whitened tobacco material within a smokeless tobacco product.

Embodiment 26: A method of any preceding embodiment, further comprising incorporating the whitened tobacco material within a smokeless tobacco product, wherein the smokeless tobacco product further comprises one or more additional components selected from the group consisting of flavorants, fillers, binders, pH adjusters, buffering agents, colorants, disintegration aids, antioxidants, humectants, and preservatives.

Embodiment 27: A smokeless tobacco product incorporating the whitened tobacco material prepared according to a method of any preceding embodiment.

Embodiment 28: A smokeless tobacco product of any preceding embodiment, comprising a water-permeable pouch containing the whitened tobacco material.

Embodiment 29: A smokeless tobacco product of any preceding embodiment, further comprising one or more additional components selected from the group consisting of flavorants, fillers, binders, pH adjusters, buffering agents, colorants, disintegration aids, antioxidants, humectants, and preservatives.

Embodiment 30: A method of preparing a whitened tobacco material for use in a smokeless tobacco product, consisting essentially of: (i) extracting a tobacco material with an extraction solution to provide a tobacco solids material and a tobacco extract; (ii) separating the tobacco solids material and the tobacco extract; (iii) bleaching the tobacco solids material with a bleaching solution comprising a strong base, an oxidizing agent, or a combination thereof to provide a bleached tobacco material; and (iv) drying the bleached tobacco material to provide the whitened tobacco material.

Embodiment 31: A method of any preceding embodiment, wherein the extraction solution is an aqueous solution.

These and other features, aspects, and advantages of the disclosure will be apparent from a reading of the following detailed description together with the accompanying drawings, which are briefly described below. The invention includes any combination of two, three, four, or more of the above-noted embodiments as well as combinations of any two, three, four, or more features or elements set forth in this disclosure, regardless of whether such features or elements are expressly combined in a specific embodiment description herein. This disclosure is intended to be read holistically such that any separable features or elements of the disclosed invention, in any of its various aspects and embodiments, should be viewed as intended to be combinable unless the context clearly dictates otherwise.

BRIEF DESCRIPTION OF THE DRAWINGS

Figure 1:
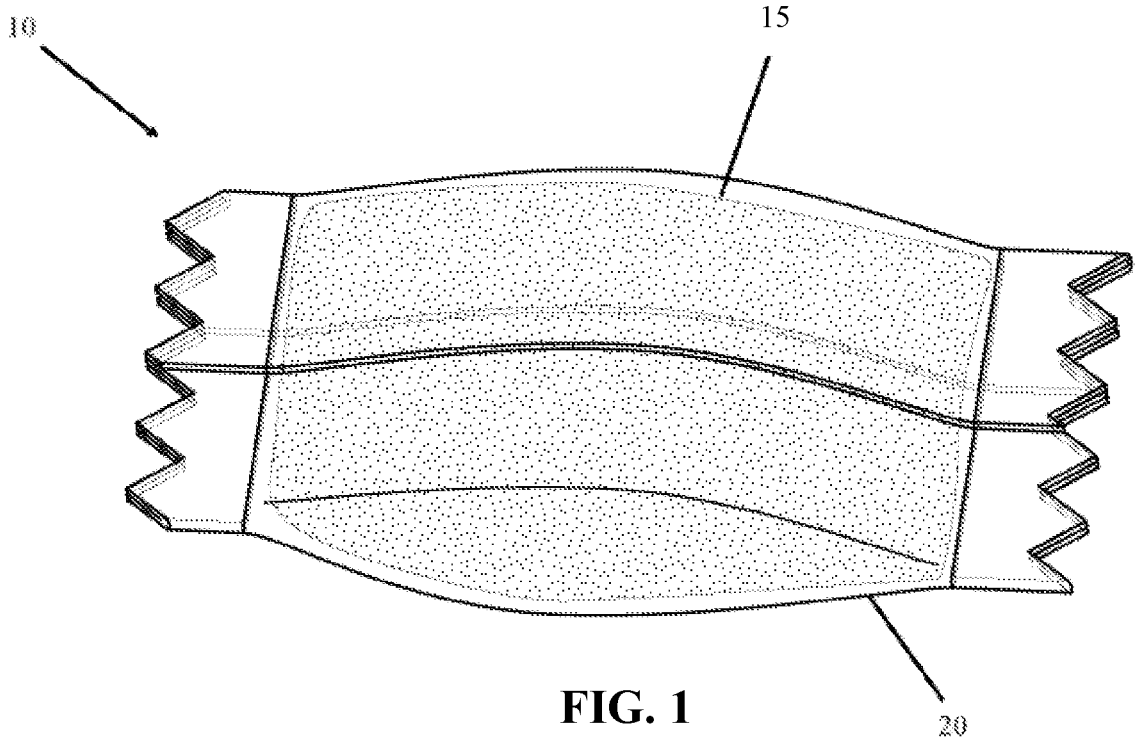
Figure 2:
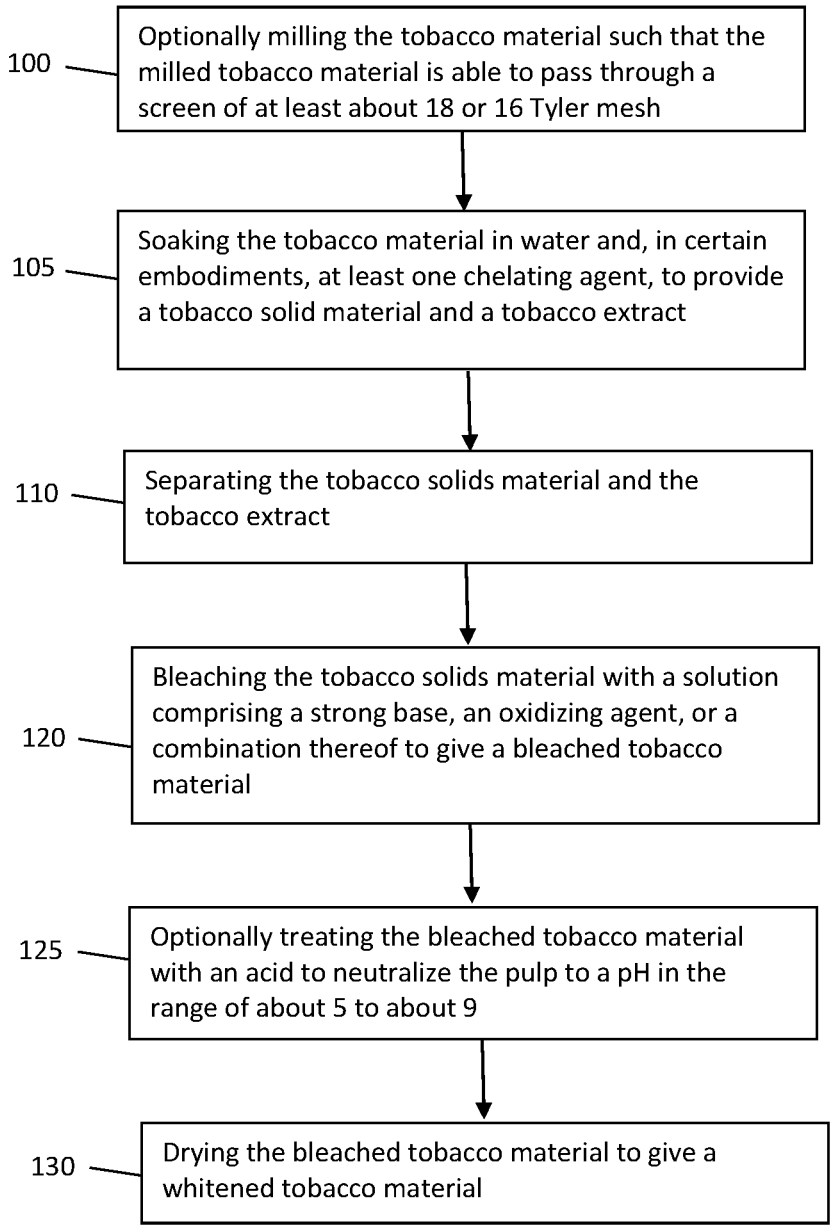

Having thus described the disclosure in the foregoing general terms, reference will now be made to the accompanying drawings, which are not necessarily drawn to scale, and wherein:

FIG. 1 is a front perspective view illustrating a pouched product according to an embodiment; and FIG. 2 is a flow chart illustrating the general steps for preparing a whitened tobacco material according to an embodiment.

DETAILED DESCRIPTION

Aspects of the present disclosure now will be described more fully hereinafter. This invention may, however, be embodied in many different forms and should not be construed as limited to the embodiments set forth herein; rather, these embodiments are provided so that this disclosure will be thorough and complete, and will fully convey the scope of the invention to those skilled in the art. As used in this specification and the claims, the singular forms "a," "an," and "the" include plural referents unless the context clearly dictates otherwise. Reference to "dry weight percent" or "dry weight basis" refers to weight on the basis of dry ingredients (i.e., all ingredients except water).

Certain embodiments will be described with reference to FIG. 1 of the accompanying drawings, and these described embodiments involve snus-type products having an outer pouch and containing a whitened tobacco material. As explained in greater detail below, such embodiments are provided by way of example only, and the smokeless tobacco product can include tobacco compositions in other forms.

Referring to FIG. 1, there is shown a first embodiment of a smokeless tobacco product 10. The tobacco product 10 includes a moisture-permeable container in the form of a pouch 20, which contains a material 15 comprising a whitened tobacco material of a type described herein. The smokeless tobacco product also may optionally comprise, in certain embodiments, a plurality of microcapsules dispersed within the tobacco filler material 15, the microcapsules containing a component (e.g., a flavorant) such as described in greater detail below.

The tobacco product 10 is typically used by placing one pouch containing the tobacco formulation in the mouth of a human subject/user. During use, saliva in the mouth of the user causes some of the components of the tobacco formulation to pass through the water-permeable pouch and into the mouth of the user. The pouch preferably is not chewed or swallowed. The user is provided with tobacco flavor and satisfaction, and is not required to spit out any portion of the tobacco formulation. After about 10 minutes to about 60 minutes, typically about 15 minutes to about 45 minutes, of use/enjoyment, substantial amounts of the tobacco formulation and the contents of the optional microcapsules and have been absorbed (via either gingival or buccal absorption) by the human subject, and the pouch may be removed from the mouth of the human subject for disposal. In certain embodiments, the pouch materials can be designed and manufactured such that under conditions of normal use, a significant amount of the tobacco formulation contents permeate through the pouch material prior to the time that the pouch undergoes loss of its physical integrity.

The present disclosure provides a whitened tobacco composition, smokeless tobacco products incorporating such whitened tobacco compositions, and methods for preparing a whitened tobacco composition and for incorporating such compositions within smokeless tobacco products. As used herein, the term "whitened" refers to a composition comprising a tobacco material that has been treated to remove some degree of color therefrom. Thus, a "whitened" tobacco material that is treated according to the methods described herein is visually lighter in hue than an untreated tobacco material. The whitened tobacco composition of the invention can be used as a component of a smokeless tobacco composition, such as loose moist snuff, loose dry snuff, chewing tobacco, pelletized tobacco pieces, extruded or formed tobacco strips, pieces, rods, or sticks, finely divided ground powders, finely divided or milled agglomerates of powdered pieces and components, flake-like pieces, molded processed tobacco pieces, pieces of tobacco-containing gum, rolls of tape-like films, readily water-dissolvable or water-dispersible films or strips, or capsule-like materials.

Tobaccos used in the tobacco compositions of the invention may vary. In certain embodiments, tobaccos that can be employed include flue-cured or Virginia (e.g., K326), burley, sun-cured (e.g., Indian Kurnool and Oriental tobaccos, including Katerini, Prelip, Komotini, Xanthi and Yambol tobaccos), Maryland, dark, dark-fired, dark air cured (e.g., Passanda, Cubano, Jatin and Bezuki tobaccos), light air cured (e.g., North Wisconsin and Galpao tobaccos), Indian air cured, Red Russian and *Rustica* tobaccos, as well as various other rare or specialty tobaccos and various blends of any of the foregoing tobaccos. Descriptions of various types of tobaccos, growing practices and harvesting practices are set forth in *Tobacco Production, Chemistry and Technology*, Davis et al. (Eds.) (1999), which is incorporated herein by reference. Various representative other types of plants from the *Nicotiana* species are set forth in Goodspeed, *The Genus Nicotiana*, (Chonica Botanica) (1954); U.S. Pat. No. 4,660,577 to Sensabaugh, Jr. et al.; U.S. Pat. No. 5,387,416 to White et al. and U.S. Pat. No. 7,025,066 to Lawson et al.; US Patent Appl. Pub. Nos. 2006/0037623 to Lawrence, Jr. and 2008/0245377 to Marshall et al.; each of which is incorporated herein by reference. Example *Nicotiana* species include *N. tabacum, N. rustica, N. alata, N. arentsii, N. excelsior, N. forgetiana, N. glauca, N. glutinosa, N. gossei, N. kawakamii, N. knightiana, N. langsdorffi, N. otophora, N. setchelli, N. sylvestris, N. tomentosa, N. tomentosiformis, N. undulata, N. x sanderae, N. africana, N. amplexicaulis, N. benavidesii, N. bonariensis, N. debneyi, N. longiflora, N. maritina, N. megalosiphon, N. occidentalis, N. paniculata, N. plumbaginifolia, N. raimondii, N. rosulata, N. simulans, N. stocktonii, N. suaveolens, N. umbratica, N. velutina, N. wigandioides, N. acaulis, N. acuminata, N. attenuata, N. benthamiana, N. cavicola, N. clevelandii, N. cordifolia, N. corymbosa, N. fragrans, N. goodspeedii, N. linearis, N. miersii, N. nudicaulis, N. obtusifolia, N. occidentalis* subsp. *Hersperis, N. pauciflora, N. petunioides, N. quadrivalvis, N. repanda, N. rotundifolia, N. solanifolia*, and *N. spegazzinii.*

*Nicotiana* species can be derived using genetic-modification or crossbreeding techniques (e.g., tobacco plants can be genetically engineered or crossbred to increase or decrease production of components, characteristics or attributes). See, for example, the types of genetic modifications of plants set forth in U.S. Pat. No. 5,539,093 to Fitzmaurice et al.; U.S. Pat. No. 5,668,295 to Wahab et al.; U.S. Pat. No. 5,705,624 to Fitzmaurice et al.; U.S. Pat. No. 5,844,119 to Weigl; U.S. Pat. No. 6,730,832 to Dominguez et al.; U.S. Pat. No. 7,173,170 to Liu et al.; U.S. Pat. No. 7,208,659 to Colliver et al. and U.S. Pat. No. 7,230,160 to Benning et al.; US Patent Appl. Pub. No. 2006/0236434 to Conkling et al.; and PCT WO 2008/103935 to Nielsen et al. See, also, the types of tobaccos that are set forth in U.S. Pat. No. 4,660,577 to Sensabaugh, Jr. et al.; U.S. Pat. No. 5,387,416 to White et al.; and U.S. Pat. No. 6,730,832 to Dominguez et al., each of which is incorporated herein by reference. Most preferably, the tobacco materials are those that have been appropriately cured and aged. Especially preferred techniques and conditions for curing flue-cured tobacco are set forth in Nestor et al., Beitrage Tabakforsch. Int., 20 (2003) 467-475 and U.S. Pat. No. 6,895,974 to Peele, which are incorporated herein by reference. Representative techniques and conditions for air curing tobacco are set forth in Roton et al., Beitrage Tabakforsch. Int., 21 (2005) 305-320 and Staaf et al., Beitrage Tabakforsch. Int., 21 (2005) 321-330, which are incorporated herein by reference. Certain types of unusual or rare tobaccos can be sun cured. Manners and methods for improving the smoking quality of Oriental tobaccos are set forth in U.S. Pat. No. 7,025,066 to Lawson et al., which is incorporated herein by reference. Representative Oriental tobaccos include katerini, prelip, komotini, xanthi and yambol tobaccos. Tobacco compositions including dark air cured tobacco are set forth in US Patent Appl. Pub. No. 2008/0245377 to Marshall et al., which is incorporated herein by reference. See also, types of tobacco as set forth, for example, in US Patent Appl. Pub. No. 2011/0247640 to Beeson et al., which is incorporated herein by reference.

The *Nicotiana* species can be selected for the content of various compounds that are present therein. For example, plants can be selected on the basis that those plants produce relatively high quantities of one or more of the compounds desired to be isolated therefrom. In certain embodiments, plants of the *Nicotiana* species (e.g., *Galpao commun* tobacco) are specifically grown for their abundance of leaf surface compounds. Tobacco plants can be grown in greenhouses, growth chambers, or outdoors in fields, or grown hydroponically.

Various parts or portions of the plant of the *Nicotiana* species can be employed. For example, virtually all of the plant (e.g., the whole plant) can be harvested, and employed as such. Alternatively, various parts or pieces of the plant can be harvested or separated for further use after harvest. For example, the flower, leaves, stem, stalk, roots, seeds, and various combinations thereof, can be isolated for further use or treatment. In some embodiments, the tobacco material subjected to the treatments set forth herein is *Rustica* stems in milled form.

The post-harvest processing of the plant or portion thereof can vary. After harvest, the plant, or portion thereof, can be used in a green form (e.g., the plant or portion thereof can be used without being subjected to any curing process). For example, the plant or portion thereof can be used without being subjected to significant storage, handling or processing conditions. In certain situations, it is advantageous for the plant or portion thereof be used virtually immediately after harvest. Alternatively, for example, a plant or portion thereof in green form can be refrigerated or frozen for later use, freeze dried, subjected to irradiation, yellowed, dried, cured (e.g., using air drying techniques or techniques that employ application of heat), heated or cooked (e.g., roasted, fried or boiled), or otherwise subjected to storage or treatment for later use.

The harvested plant or portion thereof can be physically processed. The plant or portion thereof can be separated into individual parts or pieces (e.g., the leaves can be removed from the stems, and/or the stems and leaves can be removed from the stalk). The harvested plant or individual parts or pieces can be further subdivided into parts or pieces (e.g., the leaves can be shredded, cut, comminuted, pulverized, milled or ground into pieces or parts that can be characterized as filler-type pieces, granules, particulates or fine powders). The plant, or parts thereof, can be subjected to external forces or pressure (e.g., by being pressed or subjected to roll treatment). When carrying out such processing conditions, the plant or portion thereof can have a moisture content that approximates its natural moisture content (e.g., its moisture content immediately upon harvest), a moisture content achieved by adding moisture to the plant or portion thereof, or a moisture content that results from the drying of the plant or portion thereof. For example, powdered, pulverized, ground or milled pieces of plants or portions thereof can have moisture contents of less than about 25 weight percent, often less than about 20 weight percent, and frequently less than about 15 weight percent.

Tobacco compositions intended to be used in a smokeless form such as that in FIG. 1 may incorporate a single type of tobacco (e.g., in a so-called "straight grade" form). For example, the tobacco within a tobacco composition may be composed solely of flue-cured tobacco (e.g., all of the tobacco may be composed, or derived from, either flue-cured tobacco lamina or a mixture of flue-cured tobacco lamina and flue-cured tobacco stem). In one embodiment, the tobacco comprises or is composed solely of sun-cured milled *Rustica* stems (i.e., *N. rustica* stems). The tobacco within a tobacco composition also may have a so-called "blended" form. For example, the tobacco within a tobacco composition of the present invention may include a mixture of parts or pieces of flue-cured, burley (e.g., Malawi burley tobacco) and Oriental tobaccos (e.g., as tobacco composed of, or derived from, tobacco lamina, or a mixture of tobacco lamina and tobacco stem).

Portions of the tobaccos within the tobacco product may have processed forms, such as processed tobacco stems (e.g., cut-rolled stems, cut-rolled-expanded stems or cut-puffed stems), or volume expanded tobacco (e.g., puffed tobacco, such as dry ice expanded tobacco (DIET)). See, for example, the tobacco expansion processes set forth in U.S. Pat. No. 4,340,073 to de la Burde et al.; U.S. Pat. No. 5,259,403 to Guy et al.; and U.S. Pat. No. 5,908,032 to Poindexter, et al.; and U.S. Pat. No. 7,556,047 to Poindexter, et al., all of which are incorporated by reference. In addition, the tobacco product optionally may incorporate tobacco that has been fermented. See, also, the types of tobacco processing techniques set forth in PCT WO 05/063060 to Atchley et al., which is incorporated herein by reference.

In certain embodiments, the starting tobacco material can include tobacco stems. As used herein, "stem" refers to the long thing part of a tobacco plant from which leaves or flowers grow, and can include the leaves, lamina, and/or flowers. In some embodiments, it can be advantageous to use stalks and/or roots of the tobacco plant. The tobacco stalks and/or roots can be separated into individual pieces (e.g., roots separated from stalks, and/or root parts separated from each other, such as big root, mid root, and small root parts) or the stalks and roots may be combined. By "stalk" is meant the stalk that is left after the leaf (including stem and lamina) has been removed. "Root" and various specific root parts useful according to the present invention may be defined and classified as described, for example, in Mauseth, Botany: An Introduction to Plant Biology: Fourth Edition, Jones and Bartlett Publishers (2009) and Glimn-Lacy et al., Botany Illustrated, Second Edition, Springer (2006), which are incorporated herein by reference. The harvested stalks and/or roots are typically cleaned, ground, and dried to produce a material that can be described as particulate (i.e., shredded, pulverized, ground, granulated, or powdered). As used herein, stalks and/or roots can also refer to stalks and/or roots that have undergone an extraction process to remove water soluble materials. The cellulosic material (i.e., tobacco solids material) remaining after stalks and/or root materials undergo an extraction process can also be useful in the present invention.

Although the tobacco material may comprise material from any part of a plant of the *Nicotiana* species, in certain embodiments, the majority of the material can comprise material obtained from the stems, stalks and/or roots of the plant. For example, in certain embodiments, the tobacco material comprises at least about 90%, at least about 92%, at least about 95%, or at least about 97% by dry weight of at least one of the stem material, the stalk material and the root material of a harvested plant of the *Nicotiana* species.

The tobacco material used in the present invention is typically provided in a shredded, ground, granulated, fine particulate, or powder form. As illustrated at operation 100 of FIG. 2, the tobacco whitening process described herein can include optionally milling a tobacco material. Most preferably, the tobacco is employed in the form of parts or pieces that have an average particle size less than that of the parts or pieces of shredded tobacco used in so-called "fine cut" tobacco products. Typically, the very finely divided tobacco particles or pieces are sized to pass through a screen of about 18 or 16 U.S. sieve size, generally are sized to pass a screen of about 20 U.S. sieve size, often are sized to pass through a screen of about 50 U.S. sieve size, frequently are sized to pass through a screen of about 60 U.S. sieve size, may even be sized to pass through a screen of 100 U.S. sieve size, and further may be sized so as to pass through a screen of 200 U.S. sieve size. It is noted that two scales commonly used to classify particle sizes are the U.S. Sieve Series and Tyler Equivalent. Sometimes these two scales are referred to as Tyler Mesh Size or Tyler Standard Sieve Series. U.S. sieve size is referred to in the present application. If desired, air classification equipment may be used to ensure that small sized tobacco particles of the desired sizes, or range of sizes, may be collected. In one embodiment, the tobacco material is in particulate form sized to pass through an 18 or 16 U.S. sieve size, but not through a 60 U.S. sieve size. If desired, differently sized pieces of granulated tobacco may be mixed together. Typically, the very finely divided tobacco particles or pieces suitable for snus products have a particle size greater than −8 U.S. sieve size, often −8 to +100 U.S. sieve size, frequently −16 to +60 U.S. sieve size. In certain embodiments, the tobacco is provided with an average particle size of about 0.2 to about 2 mm, about 0.5 to about 1.5 mm, about 0.2 to about 1.0 mm, or about 0.75 to about 1.25 mm (e.g., about 1 mm).

The manner by which the tobacco is provided in a finely divided or powder type of form may vary. Preferably, tobacco parts or pieces are comminuted, ground or pulverized into a powder type of form using equipment and techniques for grinding, milling, or the like. Most preferably, the tobacco is relatively dry in form during grinding or milling, using equipment such as hammer mills, cutter heads, air control mills, or the like. For example, tobacco parts or pieces may be ground or milled when the moisture content thereof is less than about 15 weight percent to less than about 5 weight percent. The tobacco material can be processed to provide it in the desired form before and/or after being subjected to the whitening and/or clarification processes described herein.

In some embodiments, the type of tobacco material that is treated (i.e., subjected to the processes described herein) is selected such that it is initially visually lighter in color than other tobacco materials to some degree. Accordingly, one optional step of the method described herein comprises screening various tobacco materials and selecting one or more of the tobacco materials based on their visual appearance (i.e., their "lightness," or "whiteness"). Where conducted, this screening step can, in some embodiments, comprise a visual screening wherein certain tobacco materials (e.g., certain tobacco types) are selected that are visually lighter in hue than other tobacco materials. In some embodiments, the screening can be conducted by means of an automated operation that selects certain tobacco materials based on predetermined characteristics (e.g., having a lightness above a given threshold value). For example, optical instruments (e.g., spectrophotometer/spectroreflectometer) and/or optical sorting equipment can be used for this purpose. Such equipment is available, for example, from Autoelrepho® Products, AZ Technology, Hunter Lab, X-Rite, SpecMetrix, and others.

In various embodiments, the tobacco material can be treated to extract one or more soluble components from the tobacco material. See, e.g., the whitening methods described in U.S. application Ser. No. 16/227,742 filed Dec. 20, 2018, which is incorporated herein by reference. As illustrated in FIG. 2, this first treatment step can comprise a solvent extraction at operation 105 comprising contacting the tobacco material with a solvent (e.g., water) for a time and at a temperature sufficient to cause the extraction of one or more components of the tobacco material into the solvent, and separating the extract from the residual tobacco solid material. "Tobacco solid material" as used herein is the solid, residual tobacco material that remains after the liquid component (i.e., tobacco extract) is removed from the material in step 105. "Tobacco extract" as used herein refers to the isolated components of a tobacco material that are extracted from solid tobacco material by a solvent that is brought into contact with the tobacco material in an extraction process in step 105.

Various extraction techniques of tobacco materials can be used to provide a tobacco extract and tobacco solid material. See, for example, the extraction processes described in US Pat. Appl. Pub. No. 2011/0247640 to Beeson et al., which is incorporated herein by reference. Other example techniques for extracting components of tobacco are described in U.S. Pat. No. 4,144,895 to Fiore; U.S. Pat. No. 4,150,677 to Osborne, Jr. et al.; U.S. Pat. No. 4,267,847 to Reid; U.S. Pat. No. 4,289,147 to Wildman et al.; U.S. Pat. No. 4,351,346 to Brummer et al.; U.S. Pat. No. 4,359,059 to Brummer et al.; U.S. Pat. No. 4,506,682 to Muller; U.S. Pat. No. 4,589,428 to Keritsis; U.S. Pat. No. 4,605,016 to Soga et al.; U.S. Pat. No. 4,716,911 to Poulose et al.; U.S. Pat. No. 4,727,889 to Niven, Jr. et al.; U.S. Pat. No. 4,887,618 to Bernasek et al.; U.S. Pat. No. 4,941,484 to Clapp et al.; U.S. Pat. No. 4,967,771 to Fagg et al.; U.S. Pat. No. 4,986,286 to Roberts et al.; U.S. Pat. No. 5,005,593 to Fagg et al.; U.S. Pat. No. 5,018,540 to Grubbs et al.; U.S. Pat. No. 5,060,669 to White et al.; U.S. Pat. No. 5,065,775 to Fagg; U.S. Pat. No. 5,074,319 to White et al.; U.S. Pat. No. 5,099,862 to White et al.; U.S. Pat. No. 5,121,757 to White et al.; U.S. Pat. No. 5,131,414 to Fagg; U.S. Pat. No. 5,131,415 to Munoz et al.; U.S. Pat. No. 5,148,819 to Fagg; U.S. Pat. No. 5,197,494 to Kramer; U.S. Pat. No. 5,230,354 to Smith et al.; U.S. Pat. No. 5,234,008 to Fagg; U.S. Pat. No. 5,243,999 to Smith; U.S. Pat. No. 5,301,694 to Raymond et al.; U.S. Pat. No. 5,318,050 to Gonzalez-Parra et al.; U.S. Pat. No. 5,343,879 to Teague; U.S. Pat. No. 5,360,022 to Newton; U.S. Pat. No. 5,435,325 to Clapp et al.; U.S. Pat. No. 5,445,169 to Brinkley et al.; U.S. Pat. No. 6,131,584 to Lauterbach; U.S. Pat. No. 6,298,859 to Kierulff et al.; U.S. Pat. No. 6,772,767 to Mua et al.; and U.S. Pat. No. 7,337,782 to Thompson, all of which are incorporated by reference herein. In certain embodiments, the solvent is added to the tobacco material and the material is soaked for a given period of time (e.g., about 1 h); the extraction product is then filtered to give a tobacco solid material and the solvent and any solubles contained therein are filtered off to give a tobacco extract.

The solvent used for extraction of the tobacco material can vary. For example, in some embodiments, the solvent comprises a solvent having an aqueous character, such as distilled water and/or tap water. In some embodiments, hot water extraction can be used. See, e.g., Li et al, Bioresources, 8(4), 2013 (URL: https://ojs.cnr.ncsu.edu/index.php/BioRes/article/view/BioRes_08_4_5690_Li_Extraction_Hemicellulose_Aspen). In some embodiments, the solvent can have one or more additives and may contain, for example, organic and/or inorganic acids, bases, or salts, pH buffers, surfactants, or combinations thereof and may comprise minor amounts of one or more organic solvents (e.g., various alcohols, polyols, and/or humectants). The tobacco material extraction step may be carried out under acidic, neutral, or basic conditions.

See, e.g., Huang et al, Bioresources, 14(3), 2019 (URL: https://ojs.cnr.ncsu.edu/index.php/BioRes/article/view/BioRes_14_3_5544_Huang_Production_Dissolving_Grade_Pulp_Tobacco); particularly p5548 which suggests a range of extraction conditions may be effective in removing extractives from tobacco material. In one particular embodiment, the solvent comprises sodium hydroxide (NaOH) (e.g., as a 5% NaOH solution in water). In other embodiments, the solvent can comprise an organic solvent, such as an alcohol (e.g., ethanol, isopropanol, etc.), which can be used alone or in combination with an aqueous solvent. Hemicellulase, cellulase, or other enzymatic treatment may be employed in the tobacco material extraction step.

Typically, the extraction comprises adding a large excess of one or more solvents to the tobacco material so as to produce a slurry (comprising, for example, 50-90% by weight of the solvent), although the amount of solvent can vary. The solvent can be at room temperature or at an elevated temperature. For example, the solvent can be heated at a temperature of between about room temperature and about 120° C., preferably about room temperature and about 110° C. (e.g., about 100° C., about 80° C., about 60° C., about 40° C., or about 20° C.).

In some preferred embodiments, the tobacco material can be combined with water to form a moist aqueous material (e.g., in the form of a suspension or slurry) and the resulting material is typically heated to effectuate extraction of various compounds. The water used to form the moist material can be pure water (e.g., tap water or deionized water) or a mixture of water with suitable co-solvents such as certain alcohols. In certain embodiments, the amount of water added to form the moist material can be at least about 50 weight percent, or at least about 60 weight percent, or at least about 70 weight percent, based on the total weight of the moist material. In some cases, the amount of water can be described as at least about 80 weight percent or at least about 90 weight percent. In some embodiments, the ratio of the amount of water to the amount of tobacco material on a weight basis is in the range of about 5:1 to about 15:1, or about 8:1 to about 12:1. In certain embodiments, the ratio of the amount of water to the amount of tobacco material on a weight basis is about 9:1 (e.g., 1215 lb of water and 135 lb of tobacco material). As noted below, the tobacco material may include additional cellulosic material such as wood pulp, for example.

In certain embodiments, the tobacco material can be extracted with water and at least one chelating agent which is capable of removing transition metals from the tobacco material. Chelating agents are useful to remove certain metals from the tobacco material that could cause yellowing, and thus interfere with the whitening process. Suitable chelating agents may include, but are not limited to, EDTA, EGTA, HEDTA, DTPA, NTA, calcium citrate, calcium diacetate, calcium hexametaphosphate, citric acid, gluconic acid, dipotassium phosphate, disodium phosphate, isopropyl citrate, monobasic calcium phosphate, monoisopropyl citrate, potassium citrate, sodium acid phosphate, sodium citrate, sodium gluconate, sodium hexametaphosphate, sodium metaphosphate, sodium phosphate, sodium pyrophosphate, sodium tripolyphosphate, stearyl citrate, tetra sodium pyrophosphate, calcium disodium ethylene diamine tetra-acetate, glucono delta-lactone, potassium gluconate and the like, and their analogs, homologs and derivatives; as described in U.S. Pat. No. 9,321,806 to Lo et al., which has been incorporated by reference herein in its entirety. For example, the tobacco material can be extracted with an aqueous solution comprising ethylenediaminetetraacetic acid (EDTA). In some embodiments, the chelating agent can comprise diethylenetriamine pentaacetic acid (DTPA). In various embodiments, the chelating agent(s) can be present in an amount of about 0.01 to about 5.0 dry weight percent, about 0.1 to about 2.0 dry weight percent, about 0.5 to about 1.5 dry weight percent, about 0.1 to about 0.5 dry weight percent, or about 0.7 to about 1.0 dry weight percent, based on the total dry weight of the tobacco material.

The amount of time for which the tobacco material remains in contact with the solvent can vary. For example, in some embodiments, the tobacco material is in contact with the solvent for about thirty minutes to about six hours (e.g., about 1 hour, about 2 hours, about 3 hours, about 4 hours, about 5 hours, or about 6 hours), although shorter and longer time periods can be used. The amount of time can depend, for example, on the temperature of the solvent. For example, less time may be required to extract the tobacco material using solvent at a higher temperature than that required to extract the tobacco material with room temperature or cold solvent. The extraction process provides a tobacco solid material and a tobacco extract.

The number of extraction steps can vary. For example, in certain embodiments, the tobacco material is extracted one or more times, two or more times, three or more times, four or more times, or five or more times. In some embodiments, extraction can be performed in a counter-current or washing of the tobacco material. The solvent used for each extraction can vary. For example, in one particular embodiment, one or more extractions are conducted using hot water; and in a final extraction, the extraction is conducted using a basic solution (e.g., a 5% NaOH solution). After each extraction step, the tobacco solid material is filtered and the solvent and solubles are removed from the tobacco solid material. In certain embodiments, the extracts obtained from each extraction can be combined and clarified, as described in U.S. Pat. No. 9,420,825 to Beeson et al., which is herein incorporated by reference in its entirety. In other embodiments, some extracts are discarded, such as extracts from later stages. In such embodiments, for example, it may be desirable in some embodiments to use only the tobacco extract obtained from a first extraction of a tobacco material or to combine tobacco extracts obtained from a first and second extraction of a tobacco material.

Following the extraction process, the tobacco solids material is generally isolated from the tobacco extract, as illustrated at operation 110 of FIG. 2, for example, by filtration or centrifugation, although these methods are not intended to be limiting. Alternatively, in some embodiments, the tobacco solids material can be isolated from the extract by means of distillation (e.g., steam distillation) of the tobacco mixture (e.g., the tobacco slurry). The process of filtration can comprise passing the liquid through one or more filter screens to remove selected sizes of particulate matter. Screens may be, for example, stationary, vibrating, rotary, or any combination thereof. Filters may be, for example, press filters or pressure filters. In some embodiments, the filtration method used can involve microfiltration, ultrafiltration, and/or nanofiltration. A filter aid can be employed to provide effective filtration and can comprise any material typically used for this purpose. For example, some common filter aids include cellulose fibers, perlite, bentonite, diatomaceous earth, and other silaceous materials. To remove solid components, alternative methods can also be used, for example, centrifugation or settling/sedimentation of the components and siphoning off of the liquid. See, for example, the processes and products described in U.S. Pat. App. Pub. Nos. 2012/0152265 to Dube et al. and 2012/0192880 to Dube et al., herein incorporated by reference in their entireties. The extracted solids component can be used as the starting tobacco material in various embodiments of the whitening process described herein.

Tobacco solids material that has been provided and isolated following the extraction step(s) are bleached (i.e., whitened) according to any means known in the art, as shown in step 120 of FIG. 2. It is noted that in certain embodiments, a combination of tobacco solids material and wood pulp may undergo a whitening step or any other process step described herein; however, for convenience, the following description refers only to tobacco solids material. For example, whitening methods using various bleaching or oxidizing agents and oxidation catalysts can be used. Example oxidizing agents include peroxides (e.g., hydrogen peroxide), chlorite salts, chlorate salts, perchlorate salts, hypochlorite salts, ozone, ammonia, and combinations thereof. Example oxidation catalysts are titanium dioxide, manganese dioxide, and combinations thereof. Processes for treating tobacco with bleaching agents are discussed, for example, in U.S. Pat. No. 787,611 to Daniels, Jr.; U.S. Pat. No. 1,086,306 to Oelenheinz; U.S. Pat. No. 1,437,095 to Delling; U.S. Pat. No. 1,757,477 to Rosenhoch; U.S. Pat. No. 2,122,421 to Hawkinson; U.S. Pat. No. 2,148,147 to Baier; U.S. Pat. No. 2,170,107 to Baier; U.S. Pat. No. 2,274,649 to Baier; U.S. Pat. No. 2,770,239 to Prats et al.; U.S. Pat. No. 3,612,065 to Rosen; U.S. Pat. No. 3,851,653 to Rosen; U.S. Pat. No. 3,889,689 to Rosen; U.S. Pat. No. 3,943,945 to Rosen; U.S. Pat. No. 4,143,666 to Rainer; U.S. Pat. No. 4,194,514 to Campbell; U.S. Pat. Nos. 4,366,823, 4,366,824, and 4,388,933 to Rainer et al.; U.S. Pat. No. 4,641,667 to Schmekel et al.; and U.S. Pat. No. 5,713,376 to Berger; and PCT WO 96/31255 to Giolvas, all of which are incorporated herein by reference. Other whitening methods using reagents such as ozone and potassium permanganate can also be used. See, for example, U.S. Pat. No. 3,943,940 to Minami, which is incorporated herein by reference.

In certain embodiments of the present invention, tobacco material is bleached using a caustic reagent and/or an oxidizing agent. In some embodiments, the tobacco solids material is whitened using both a caustic reagent and an oxidizing agent. In such embodiments, the caustic reagent and oxidizing agent can be provided separately or can be combined. Stepwise addition of a strong base and/or bleaching agent may be used in the bleaching stage. See, e.g., Zhao et al, Bioresources, 5(1), 276-210, 2010; URL: https://pdfs.semanticscholar.org/8e78/9d93d8cc673e2f13b8daee35e3477c51b3fe.pdf; Sun, Hou, Journal of Bioresources and Bioproducts, 3(1),35-39, 2018; URL: http://www.bioresources-bioproducts.com/index.php/bb/article/view/110/109. In certain embodiments, multiple oxidative bleaching stages may be applied after the initial extraction stage.

The caustic reagent can vary and can be, for example, any strong base, including but not limited to, an alkaline metal hydroxide, alkaline earth metal hydroxide, or mixture thereof. In certain example embodiments, the caustic reagent is sodium hydroxide or potassium hydroxide. Alternative reagents that can be used include, but are not limited to, ammonium hydroxide, sodium carbonate, potassium carbonate, ammonia gas, and mixtures thereof. The caustic reagent is generally provided in solution form (e.g., in aqueous solution) and the concentration of the caustic reagent in the solution can vary. Also, the amount of caustic reagent used in the methods of the present invention can vary. For example, in certain embodiments, the caustic reagent is provided in an amount of between about 1% and about 50% dry weight basis (e.g., between about 1% and about 40% or between about 1% and about 30%) by weight of the (dry) tobacco solids material. For example, the caustic reagent can be provided in an amount of about 2%, about 5%, about 7%, about 10%, or about 25% by weight of the (dry) tobacco solids material. It is noted that the quantity of caustic reagent required may, in certain embodiments, vary as a result of the strength of the caustic reagent. For example, more caustic reagent may, in some embodiments, be required where the caustic reagent is a weaker base, whereas less caustic reagent may, in some embodiments, be required where the caustic reagent is a strong base.

The oxidizing agent (i.e., oxidant or oxidizer) can be any substance that readily transfers oxygen atoms and/or gains electrons in a reduction/oxidation (redox) chemical reaction. Peroxides (e.g., hydrogen peroxide, peracetic acid) are preferred oxidizing agents; however, any oxidizing reagent, including, but not limited to; other oxides (including nitrous oxide, silver oxide, chromium trioxide, chromate, dichromate, pyridinium chlorochromate; and osmium tetroxide); oxygen ($O_2$); ozone ($O_3$); fluorine ($F_2$); chlorine ($Cl_2$); and other halogens; hypochlorite, chlorite, chlorate, perchlorite, and other halogen analogues thereof; nitric acid; nitrate compounds; sulfuric acid; persulfuric acids; hydroxyl radicals; manganate and permanganate compounds (e.g., potassium permanganate); sodium perborate; 2,2'-diphyridyldisulfide; and combinations thereof can be used according to the invention. Peroxide activators such as TAED (tetraacetylethylenediamine) which generates in situ peracetic acid may be used in the peroxide bleaching stage. See, e.g., URLs: https://www.tappi.org/content/events/07recycle/presentation/hsieh.pdf, Zhao et al, Bioresources, 5(1), 276-210, 2010, https://pdfs.semanticscholar.org/8e78/9d93d8cc673e2f13b8daee35e3477c51b3fe.pdf.

In certain preferred embodiments, the oxidizing reagent used according to the invention is chlorine-free. In certain embodiments, the oxidizing reagent is provided in aqueous solution form. The amount of oxidizing agent used in the methods of the present invention can vary. For example, in certain embodiments, the oxidizing agent is provided in a weight amount of about 0.1 to fifty times the weight of the (dry) tobacco solids material. For example, in some embodiments, the oxidizing agent is provided in a weight amount about equal to the weight of the (dry) tobacco solids material, about 0.25 times the weight of the (dry) tobacco solids material, about 0.5 times the weight of the (dry) tobacco solids material, about 0.7 times the weight of the (dry) tobacco solids material, about 1.0 times the weight of the (dry) tobacco solids material, about 1.25 times the weight of the (dry) tobacco solids material, about 1.5 times the weight of the (dry) tobacco solids material, about 2 times the weight of the (dry) tobacco solids material, or about 5 times the weight of the (dry) tobacco solids material. In some embodiments, the oxidizing agent is provided in a weight amount in the range of about 0.1 to about 5 times the weight of the (dry) tobacco solids material, about 0.2 to about 2.5 times the weight of the (dry) tobacco solids material, about 0.25 to about 1.5 times the weight of the (dry) tobacco solids material, about 0.5 to about 1.0 times the weight of the (dry) tobacco solids material, or about 0.7 to about 0.9 times the weight of the (dry) tobacco solids material. Different oxidizing agents can have different application rates. In certain embodiments wherein the oxidizing agent comprises hydrogen peroxide, the bleaching solution can comprise hydrogen peroxide in a weight of about 0.25-1.5 times the weight of the dry tobacco solids material.

The solids content of the oxidative bleaching stage may be adjusted. Without being limited by theory, higher solids content may be beneficial and result in the need for less oxidative bleaching agent to achieve a target whiteness (or brightness). For example, in certain embodiments, the bleaching solution can include about 0.7-0.9 times more oxidizing agent than dry tobacco material (at about 10% solids), about 1.0 times more oxidizing agent than dry tobacco material (at about 4.5% solids).

In some embodiments, a >25% solids content may be beneficial. See, e.g., https://www.valmet.com/pulp/mechanical-pulping/bleaching/bleach-tower/; https://www.valmet.com/pulp/mechanical-pulping/bleaching/high-consistency-bleaching-phc/).

As noted above, the percentage of solids during bleaching can vary and can have an impact on the effectiveness of the bleaching operation. As described in the Examples below, the solids percentage is calculated using the following formula:

$$\text{Solids (\%)}=100\times(\text{wt dry tobacco})/(\text{wt dry tobacco}+\text{wt water}+\text{wt oxidizing agent})$$

In various embodiments, the percentage of solids can be in the range of about 1-20%, about 3-15%, or about 3-10%. In some embodiments, the percentage of solids can be in the range of about 2-5%, or about 8-12%. The percentage of solids can be, for example, at least about 2%, at least about 3%, at least about 4%, at least about 5%, or at least about 10%.

In various embodiments, the bleaching process can further include treatment with one or more stabilizers in addition to an oxidizing agent. For example, the stabilizer can be selected from the group consisting of magnesium sulfate, sodium silicate, and combinations thereof. In various embodiments, the stabilizer(s) can be present in an amount of about 0.01 to about 3.0 dry weight percent, about 0.1 to about 2.5 dry weight percent, or about 0.5 to about 2.0 dry weight percent, based on the total dry weight of the tobacco material solids material.

In various embodiments, the bleaching step 120 can further include treatment with at least one chelating agent. Suitable chelating agents may include, but are not limited to EDTA, EGTA, HEDTA, DTPA, NTA, calcium citrate, calcium diacetate, calcium hexametaphosphate, citric acid, gluconic acid, dipotassium phosphate, disodium phosphate, isopropyl citrate, monobasic calcium phosphate, monoisopropyl citrate, potassium citrate, sodium acid phosphate, sodium citrate, sodium gluconate, sodium hexametaphosphate, sodium metaphosphate, sodium phosphate, sodium pyrophosphate, sodium tripolyphosphate, stearyl citrate, tetra sodium pyrophosphate, calcium disodium ethylene diamine tetra-acetate, glucono delta-lactone, potassium gluconate and the like, and their analogs, homologs and derivatives; as described in U.S. Pat. No. 9,321,806 to Lo et al., which has been incorporated by reference herein in its entirety.

According to the invention, the tobacco solids material is brought into contact with the caustic reagent and/or oxidizing agent for a period of time. The tobacco material can be brought into contact with the caustic reagent and oxidizing reagent simultaneously, or can be brought into contact with the caustic reagent and oxidizing reagent separately. In one embodiment, the oxidizing reagent is added to the tobacco material and then the caustic reagent is added to the tobacco material such that, after addition, both reagents are in contact with the tobacco material simultaneously. In another embodiment, the caustic reagent is added to the tobacco material and then the oxidizing reagent is added to the tobacco material such that, after addition, both reagents are in contact with the tobacco material simultaneously.

The weight ratio of the oxidizing agent to caustic reagent can vary. In certain embodiments, such as where the caustic reagent is NaOH and the oxidizing agent is hydrogen peroxide, the weight ratio of hydrogen peroxide to NaOH is from about 1:1 to about 100:1, preferably from about 5:1 to about 50:1, and more preferably from about 5:1 to about 15:1. In certain embodiments, the weight ratio of hydrogen peroxide to NaOH is between about 2.5:1 to about 13:1, or about 8:1 and about 13:1. These ratios are not limited to ratios of NaOH and hydrogen peroxide and could also be applicable to other caustic reagent and oxidizing agent combinations.

The time for which the tobacco material is contacted with the caustic reagent and/or oxidizing agent can vary. For example, in certain embodiments, the time for which the tobacco material is contacted with the caustic reagent and/or oxidizing agent is that amount of time sufficient to provide a tobacco solids material with a lightened color as compared to the untreated tobacco material. In certain embodiments, the tobacco material is contacted with the caustic reagent and/or oxidizing agent overnight. Normally, the time period is a period of at least about 10 minutes, typically at least about 20 minutes, more often at least about 30 minutes. In certain embodiments, the time period is a period of no more than about 10 hours, no more than about 8 hours, no more than about 6 hours, no more than about 4 hours, no more than about 2 hours, or no more than about 1 hour.

In certain embodiments, the tobacco material can be heated during treatment with the caustic reagent and/or oxidizing agent. Generally, heating the tobacco material accelerates the whitening process. Where the tobacco material is heated during treatment, sufficient color lightening is typically achieved in less time than in embodiments wherein the tobacco material is unheated during treatment. The temperature and time of the heat treatment process will vary, and generally, the length of the heat treatment will decrease as the temperature of the heat treatment increases. In certain embodiments, the mixture of tobacco material, caustic reagent, and/or oxidizing agent can be heated at a temperature of between room temperature and about 100° C. (e.g., about 90° C. or about 80° C.). Preferably, the mixture is heated between room temperature and about 75° C. The heating, where applicable, can be accomplished using any heating method or apparatus known in the art. The heating can be carried out in an enclosed vessel (e.g., one providing for a controlled atmospheric environment, controlled atmospheric components, and a controlled atmospheric pressure), or in a vessel that is essentially open to ambient air. The temperature can be controlled by using a jacketed vessel, direct steam injection into the tobacco, bubbling hot air through the tobacco, and the like. In certain embodiments, the heating is performed in a vessel also capable of providing mixing of the composition, such as by stirring or agitation. Example mixing vessels include mixers available from Scott Equipment Company, Littleford Day, Inc., Lödige Process Technology, and the Breddo Likwifier Division of American Ingredients Company. Examples of vessels which provide a pressure controlled environment include high pressure autoclaves available from Berghof/America Inc. of Concord, Calif., and high pressure reactors available from The Parr Instrument Co. (e.g., Parr Reactor Model Nos. 4522 and 4552 described in U.S. Pat. No. 4,882,128 to Hukvari et al.). The pressure within the mixing vessel during the process can be atmospheric pressure or elevated pressure (e.g., about 10 psig to about 1,000 psig).

In other embodiments, the heating process is conducted in a microwave oven, a convection oven, or by infrared heating. Atmospheric air, or ambient atmosphere, is the preferred atmosphere for carrying out the optional heating step of the present invention. However, heating can also take place under a controlled atmosphere, such as a generally inert atmosphere. Gases such as nitrogen, argon and carbon dioxide can be used. Alternatively, a hydrocarbon gas (e.g., methane, ethane or butane) or a fluorocarbon gas also can provide at least a portion of a controlled atmosphere in certain embodiments, depending on the choice of treatment conditions and desired reaction products.

In certain embodiments, before drying the bleached tobacco material, the bleached tobacco material can be treated with an acid to neutralize the tobacco material after the bleaching process to a pH in the range of about 5 to about 11 (as illustrated at operation 125 of FIG. 2, for example), such as about 6 to about 10. The bleached tobacco material can be treated with sulfuric acid, hydrochloric acid, citric acid, or any combination thereof. Other acids known in the art can also be used to neutralize the bleached tobacco material. Following treatment with an acid, the pH of the bleached tobacco material can be approximately 7.

Following treatment of the tobacco solids material with the caustic reagent and/or oxidizing reagent, the treated tobacco material is generally filtered (i.e., isolated from the caustic reagent and/or oxidizing reagent) and dried (as illustrated at operation 130 of FIG. 2, for example) to give a whitened tobacco material. In certain embodiments, the bleached tobacco material can be dried to a moisture level of about 1-30%, about 5-20%, or about 10-15% moisture on a wet basis. As is known in the art, the term "wet basis" refers to a measurement of the water in a solid, expressed as the weight of water as a percentage of the total wet solid weight.

After drying, the whitened tobacco material can optionally be milled a size in the range of approximately about 5 mm to about 0.1 mm, or about 1 mm to about 0.1 mm. In certain embodiments, the whitened tobacco material can be milled to a size of less than about 10 mm, less than about 5 mm, less than about 2 mm, or less than about 1 mm.

In some embodiments, the whitened tobacco material thus produced can be characterized as lightened in color (e.g., "whitened") in comparison to the untreated tobacco material. Visual and/or instrumental assessments such as those previously described can be used to verify and, if desired, quantify the degree of lightening achieved by way of the presently described method of the invention. Assessment of the whiteness of a material generally requires comparison with another material. The extent of lightening can be quantified, for example, by spectroscopic comparison with an untreated tobacco sample (e.g., untreated tobacco material). White colors are often defined with reference to the International Commission on Illumination's (CIE's) chromaticity diagram. The whitened tobacco material can, in certain embodiments, be characterized as closer on the chromaticity diagram to pure white than untreated tobacco material. In whitening procedures known in the art, the extracted solids component can be subjected to certain treatments intended to breakdown the fibers of extracted solids material and/or to remove lignin (e.g., a hydrolysis step with at least one acid, a mechanical and/or chemical pulping step, a caustic wash at elevated temperature, etc.). In the whitening processes described herein, the extracted solids component is not subjected to treatment at elevated temperature with sulfur-containing reagents, organic solvents, sodium hydroxide, or an acid between the extracting step and the bleaching step.

After drying, the whitened tobacco material can have an ISO brightness of at least about 50%, at least about 55%, at least about 60%, at least about 65%, at least about 70%, or at least about 75%. In some embodiments, the whitened tobacco material described herein can have an ISO brightness in the range of about 50% to about 90%, about 55% to about 75%, or about 60% to about 70%. ISO brightness can be measured according to ISO 3688:1999 or ISO 2470-1: 2016.

Whiteness of a material can also be characterized based on ASTM E313-73 Whiteness Test. The whiteness of a whitened tobacco material prepared according to the methods disclosed herein can be in the range of about 1-30, 5-25, 10-20, or 10-15, for example. In some embodiments, the whiteness of a whitened tobacco material prepared according to the methods disclosed herein can be at least about 5, at least about 10, at least about 12, at least about 15, at least about 20, or at least about 25.

Whitened tobacco materials as described herein may also be characterized based on TAPPI 227OM-99 Freeness Test. Freeness levels can be indicated as a CSF (Canadian Standard Freeness) value. Freeness level generally is an indicator of the drainage rate of pulp. The higher the value, the easier it is to drain the pulp. Harsher bleaching processes typically used during bleaching of tobacco materials can degrade the individual fibers and undesirably reduce the freeness in bleached tobacco materials. Thus, the hitening methods provided herein can beneficially produce whitened tobacco materials with higher freeness values as compared to other whitening methods which further include a pulping operation. The freeness level of pure tobacco pulp can have a range of about 0 to about 500 CSF. In some embodiments, the freeness of the whitened tobacco materials produced herein can be in the range of about 300 CSF to about 800 CSF, or about 400 CSF to about 700 CSF, or about 500 CSF to about 650 CSF.

In various embodiments, a wood pulp is added to the tobacco materials during the overall whitening processes described herein. It is noted that wood pulp can be introduced into the whitening process at any of the steps described herein. For example, in certain embodiments, the methods described herein can further comprise mixing the tobacco input material with a wood material prior to extracting such that the wood material is also extracted. In certain embodiments, the methods described herein can further comprise mixing the tobacco solids material with a wood pulp after the extracting process. In some embodiments, the wood pulp is a bleached pulp material and can be added after the solid tobacco materials have been bleached. If unbleached wood pulp is used, an additional caustic extraction step may be required, or the wood pulp can be added to the tobacco solids material before the step of bleaching.

In various embodiments, the wood pulp can be market available wood pulp. In certain embodiments, the wood pulp can be a bleached hardwood pulp. The wood pulp added to the processes described herein can be added in an amount of about 1 to about 20 wt. %, or about 5 to about 15 wt. %, based on the total weight of the input materials used (i.e., the total weight of tobacco material and wood pulp used). In some embodiments, the wood pulp can be added in an amount of at least about 1 wt. %, at least about 5 wt. %, or at least about 10 wt. %, based on the total weight of the input materials used. In certain embodiments, the wood pulp can be added in an amount of no more than about 5 wt. %, no more than about 10 wt. %, no more than about 15 wt. %, or no more than about 20 wt. %, based on the total weight of the input materials used.

The tobacco materials discussed in the present invention can be treated and/or processed in other ways before, after, or during the process steps described above. For example, if desired, the tobacco materials can be irradiated, pasteurized, or otherwise subjected to controlled heat treatment. Such treatment processes are detailed, for example, in US Pat. Pub. No. 2009/0025738 to Mua et al., which is incorporated herein by reference. In certain embodiments, tobacco materials can be treated with water and an additive capable of inhibiting reaction of asparagine to form acrylamide upon heating of the tobacco material (e.g., an additive selected from the group consisting of lysine, glycine, histidine, alanine, methionine, glutamic acid, aspartic acid, proline, phenylalanine, valine, arginine, compositions incorporating di- and trivalent cations, asparaginase, certain non-reducing saccharides, certain reducing agents, phenolic compounds, certain compounds having at least one free thiol group or functionality, oxidizing agents, oxidation catalysts, natural plant extracts (e.g., rosemary extract), and combinations thereof), and combinations thereof. See, for example, the types of treatment processes described in US Pat. Pub. Nos. 2010/0300463 and 2011/0048434 to Chen et al., and U.S. Pat. No. 8,991,403 to Chen et al., which are all incorporated herein by reference. In certain embodiments, this type of treatment is useful where the original tobacco material is subjected to heat in the extraction and/or distillation process previously described.

The whitened tobacco material can be incorporated within a smokeless tobacco product according to the present invention. Depending on the type of tobacco product being processed, the tobacco product can include one or more additional components in addition to the whitened tobacco material as described above. For example, the whitened tobacco material can be processed, blended, formulated, combined and/or mixed with other materials or ingredients, such as other tobacco materials or flavorants, fillers, binders, pH adjusters, buffering agents, salts, sweeteners, colorants, oral care additives, disintegration aids, antioxidants, humectants, and preservatives. See, for example, those representative components, combination of components, relative amounts of those components and ingredients relative to tobacco, and manners and methods for employing those components, set forth in US Pat. Pub. Nos. 2011/0315154 to Mua et al.; 2007/0062549 to Holton, Jr. et al.; 2012/0067361 to Bjorkholm et al.; 2017/0020183 to Bjorkholm; and 2017/0112183 to Bjorkholm; and U.S. Pat. No. 7,861,728 to Holton, Jr. et al., each of which is incorporated herein by reference.

The relative amount of whitened tobacco material within the smokeless tobacco product may vary. Preferably, the amount of whitened tobacco material within the smokeless tobacco product is at least about 10%, at least about 25%, at least about 50%, at least about 60%, at least about 70%, at least about 80%, or at least about 90% on a dry weight basis of the formulation. A typical range of tobacco material within the formulation is about 1 to about 99%, more often about 10 to about 50% by weight on a dry basis.

The whitened tobacco material used for the manufacture of the smokeless tobacco products of the invention preferably is provided in a ground, granulated, fine particulate, or powdered form. Although not strictly necessary, the whitened tobacco material may be subjected to processing steps that provide a further grinding for further particle size reduction. The whitening processes of the present invention generally provide a whitened tobacco material with a decreased amount of high molecular weight compounds, leading to more interstitial room and thus higher possible water content in smokeless tobacco materials produced therefrom than those from unwhitened tobacco materials. In certain embodiments, the smokeless tobacco products produced according to the invention provide for faster nicotine release than products produced from unwhitened tobacco materials.

Example flavorants that can be used are components, or suitable combinations of those components, that act to alter the bitterness, sweetness, sourness, or saltiness of the smokeless tobacco product, enhance the perceived dryness or moistness of the formulation, or the degree of tobacco taste exhibited by the formulation. Flavorants may be natural or synthetic, and the character of the flavors imparted thereby may be described, without limitation, as fresh, sweet, herbal, confectionary, floral, fruity, or spicy. Specific types of flavors include, but are not limited to, vanilla, coffee, chocolate/cocoa, cream, mint, spearmint, menthol, peppermint, wintergreen, eucalyptus, lavender, cardamon, nutmeg, cinnamon, clove, cascarilla, sandalwood, honey, jasmine, ginger, anise, sage, licorice, lemon, orange, apple, peach, lime, cherry, strawberry, and any combinations thereof. See also, Leffingwell et al., Tobacco Flavoring for Smoking Products, R. J. Reynolds Tobacco Company (1972), which is incorporated herein by reference. Flavorings also may include components that are considered moistening, cooling or smoothening agents, such as eucalyptus. These flavors may be provided neat (i.e., alone) or in a composite (e.g., spearmint and menthol, or orange and cinnamon). Representative types of components also are set forth in U.S. Pat. No. 5,387,416 to White et al.; US Pat. App. Pub. No. 2005/0244521 to Strickland et al.; and PCT Application Pub. No. WO 05/041699 to Quinter et al., each of which is incorporated herein by reference. Types of flavorants include salts (e.g., sodium chloride, potassium chloride, sodium citrate, potassium citrate, sodium acetate, potassium acetate, and the like), natural sweeteners (e.g., fructose, sucrose, glucose, maltose, mannose, galactose, lactose, and the like), artificial sweeteners (e.g., sucralose, saccharin, aspartame, acesulfame K, neotame, and the like); and mixtures thereof. The amount of flavorants utilized in the tobacco composition can vary, but is typically up to about 10 dry weight percent, and certain embodiments are characterized by a flavorant content of at least about 1 dry weight percent, such as about 1 to about 10 dry weight percent. Combinations of flavorants are often used, such as about 0.1 to about 2 dry weight percent of an artificial sweetener, about 0.5 to about 8 dry weight percent of a salt such as sodium chloride and about 1 to about 5 dry weight percent of an additional flavoring.

Example filler materials include vegetable fiber materials such as sugar beet fiber materials (e.g., FIBREX® brand filler available from International Fiber Corporation), oats or other cereal grain (including processed or puffed grains), bran fibers, starch, or other modified or natural cellulosic materials such as microcrystalline cellulose. Additional specific examples include corn starch, maltodextrin, dextrose, calcium carbonate, calcium phosphate, lactose, manitol, xylitol, and sorbitol. The amount of filler, where utilized in the tobacco composition, can vary, but is typically up to about 60 dry weight percent, and certain embodiments are characterized by a filler content of up to about 50 dry weight percent, up to about 40 dry weight percent or up to about 30 dry weight percent. Combinations of fillers can also be used.

Typical binders can be organic or inorganic, or a combination thereof. Representative binders include povidone, sodium carboxymethylcellulose and other modified cellulosic materials, sodium alginate, xanthan gum, starch-based binders, gum arabic, pectin, carrageenan, pullulan, zein, and the like. The amount of binder utilized in the tobacco composition can vary, but is typically up to about 30 dry weight percent, and certain embodiments are characterized by a binder content of at least about 5 dry weight percent, such as about 5 to about 30 dry weight percent.

Preferred pH adjusters or buffering agents provide and/or buffer within a pH range of about 6 to about 10, and example agents include metal hydroxides, metal carbonates, metal bicarbonates, and mixtures thereof. Specific example materials include citric acid, sodium hydroxide, potassium hydroxide, potassium carbonate, sodium carbonate, and sodium bicarbonate. The amount of pH adjuster or buffering material utilized in the tobacco composition can vary, but is typically up to about 5 dry weight percent, and certain embodiments can be characterized by a pH adjuster/buffer content of less than about 0.5 dry weight percent, such as about 0.05 to about 0.2 dry weight percent. Particularly in embodiments comprising an extract clarified by distillation, the pH may be lowered by the addition of one or more pH adjusters (e.g., citric acid).

A colorant may be employed in amounts sufficient to provide the desired physical attributes to the tobacco formulation. Example colorants include various dyes and pigments, such as caramel coloring and titanium dioxide. The amount of colorant utilized in the tobacco composition can vary, but is typically up to about 3 dry weight percent, and certain embodiments are characterized by a colorant content of at least about 0.1 dry weight percent, such as about 0.5 to about 3 dry weight percent.

Example humectants include glycerin and propylene glycol. The amount of humectant utilized in the tobacco composition can vary, but is typically up to about 5 dry weight percent, and certain embodiments can be characterized by a humectant content of at least about 1 dry weight percent, such as about 2 to about 5 dry weight percent.

Other ingredients such as preservatives (e.g., potassium sorbate), disintegration aids (e.g., microcrystalline cellulose, croscarmellose sodium, crospovidone, sodium starch glycolate, pregelatinized corn starch, and the like), and/or antioxidants can also be used. Typically, such ingredients, where used, are used in amounts of up to about 10 dry weight percent and usually at least about 0.1 dry weight percent, such as about 0.5 to about 10 dry weight percent. A disintegration aid is generally employed in an amount sufficient to provide control of desired physical attributes of the tobacco formulation such as, for example, by providing loss of physical integrity and dispersion of the various component materials upon contact of the formulation with water (e.g., by undergoing swelling upon contact with water).

As noted, in some embodiments, any of the components described above can be added in an encapsulated form (e.g., in the form of microcapsules), the encapsulated form a wall or barrier structure defining an inner region and isolating the inner region permanently or temporarily from the tobacco composition. The inner region includes a payload of an additive either adapted for enhancing one or more sensory characteristics of the smokeless tobacco product, such as taste, mouthfeel, moistness, coolness/heat, and/or fragrance, or adapted for adding an additional functional quality to the smokeless tobacco product, such as addition of an antioxidant or immune system enhancing function. See, for example, the subject matter of US Pat. Appl. Pub. No. 2009/0025738 to Mua et al., which is incorporated herein by reference.

Representative tobacco formulations may incorporate about 5% to about 95% percent whitened tobacco material, about 5 to about 60% filler, about 0.1% to about 5% artificial sweetener, about 0.5% to about 2% salt, about 1% to about 5% flavoring, about 1% to about 5% humectants (e.g., propylene glycol), and up to about 10% pH adjuster or buffering agent (e.g., sodium bicarbonate or citric acid), based on the total dry weight of the tobacco formulation. The particular percentages and choice of ingredients will vary depending upon the desired flavor, texture, and other characteristics.

Descriptions of various components of snus types of products and components thereof also are set forth in US Pat. App. Pub. No. 2004/0118422 to Lundin et al., which is incorporated herein by reference. See, also, for example, U.S. Pat. No. 4,607,479 to Linden; U.S. Pat. No. 4,631,899 to Nielsen; U.S. Pat. No. 5,346,734 to Wydick et al.; and U.S. Pat. No. 6,162,516 to Derr, and US Pat. Pub. No. 2005/0061339 to Hansson et al.; each of which is incorporated herein by reference.

The components of the tobacco composition can be brought together in admixture using any mixing technique or equipment known in the art. The optional components noted above, which may be in liquid or dry solid form, can be admixed with the whitened tobacco material in a pretreatment step prior to mixture with any remaining components of the composition or simply mixed with the whitened tobacco material together with all other liquid or dry ingredients. Any mixing method that brings the tobacco composition ingredients into intimate contact can be used. A mixing apparatus featuring an impeller or other structure capable of agitation is typically used. Example mixing equipment includes casing drums, conditioning cylinders or drums, liquid spray apparatus, conical-type blenders, ribbon blenders, mixers available as FKM130, FKM600, FKM1200, FKM2000 and FKM3000 from Littleford Day, Inc., Plough Share types of mixer cylinders, and the like. As such, the overall mixture of various components with the whitened tobacco material may be relatively uniform in nature. See also, for example, the types of methodologies set forth in U.S. Pat. No. 4,148,325 to Solomon et al.; U.S. Pat. No. 6,510,855 to Korte et al.; and U.S. Pat. No. 6,834,654 to Williams, each of which is incorporated herein by reference. Manners and methods for formulating snus-type tobacco formulations will be apparent to those skilled in the art of snus tobacco product production.

The moisture content of the smokeless tobacco product prior to use by a consumer of the formulation may vary. Typically, the moisture content of the product, as present within the pouch prior to insertion into the mouth of the user, is less than about 55 weight percent, generally is less than about 50 weight percent, and often is less than about 45 weight percent. For certain tobacco products, such as those incorporating snus-types of tobacco compositions, the moisture content may exceed 20 weight percent, and often may exceed 30 weight percent. For example, a representative snus-type product may possess a tobacco composition exhibiting a moisture content of about 20 weight percent to about 50 weight percent, preferably about 20 weight percent to about 40 weight percent.

The manner by which the moisture content of the formulation is controlled may vary. For example, the formulation may be subjected to thermal or convection heating. As a specific example, the formulation may be oven-dried, in warmed air at temperatures of about 40° C. to about 95° C., with a preferred temperature range of about 60° C. to about 80° C. for a length of time appropriate to attain the desired moisture content. Alternatively, tobacco formulations may be moistened using casing drums, conditioning cylinders or drums, liquid spray apparatus, ribbon blenders, or mixers. Most preferably, moist tobacco formulations, such as the types of tobacco formulations employed within snus types of products, are subjected to pasteurization or fermentation. Techniques for pasteurizing/heat treating and/or fermenting snus types of tobacco products will be apparent to those skilled in the art of snus product design and manufacture.

The acidity or alkalinity of the tobacco formulation, which is often characterized in terms of pH, can vary. Typically, the pH of that formulation is at least about 6.5, and preferably at least about 7.5. In some embodiments, the pH of that formulation will not exceed about 11, or will not exceed about 9, and often will not exceed about 8.5. A representative tobacco formulation exhibits a pH of about 6.8 to about 8.2 (e.g., about 7.8). A representative technique for determining the pH of a tobacco formulation involves dispersing 5 g of that formulation in 100 ml of high performance liquid chromatography water, and measuring the pH of the resulting suspension/solution (e.g., with a pH meter).

In certain embodiments, the whitened tobacco material and any other components noted above are combined within a moisture-permeable packet or pouch that acts as a container for use of the tobacco. The composition/construction of such packets or pouches, such as the container pouch 20 in the embodiment illustrated in FIG. 1, may be varied. Suitable packets, pouches or containers of the type used for the manufacture of smokeless tobacco products are available under the tradenames CatchDry, Ettan, General, Granit, Goteborgs Rape, Grovsnus White, Metropol Kaktus, Mocca Anis, Mocca Mint, Mocca Wintergreen, Kicks, Probe, Prince, Skruf, Epok, and TreAnkrare. The tobacco formulation may be contained in pouches and packaged, in a manner and using the types of components used for the manufacture of conventional snus types of products. The pouch provides a liquid-permeable container of a type that may be considered to be similar in character to the mesh-like type of material that is used for the construction of a tea bag. Components of the loosely arranged, granular tobacco formulation readily diffuse through the pouch and into the mouth of the user.

Non-limiting examples of suitable types of pouches are set forth in, for example, U.S. Pat. No. 5,167,244 to Kjerstad and U.S. Pat. No. 8,931,493 to Sebastian et al.; as well as US Patent App. Pub. Nos. 2016/0000140 to Sebastian et al.; 2016/0073689 to Sebastian et al.; 2016/0157515 to Chapman et al.; and 2016/0192703 to Sebastian et al., each of which are incorporated herein by reference. Pouches can be provided as individual pouches, or a plurality of pouches (e.g., 2, 4, 5, 10, 12, 15, 20, 25 or 30 pouches) can be connected or linked together (e.g., in an end-to-end manner) such that a single pouch or individual portion can be readily removed for use from a one-piece strand or matrix of pouches.

A pouch may, for example, be manufactured from materials, and in such a manner, such that during use by the user, the pouch undergoes a controlled dispersion or dissolution. Such pouch materials may have the form of a mesh, screen, perforated paper, permeable fabric, or the like. For example, pouch material manufactured from a mesh-like form of rice paper, or perforated rice paper, may dissolve in the mouth of the user. As a result, the pouch and tobacco formulation each may undergo complete dispersion within the mouth of the user during normal conditions of use, and hence the pouch and tobacco formulation both may be ingested by the user. Other example pouch materials may be manufactured using water dispersible film forming materials (e.g., binding agents such as alginates, carboxymethylcellulose, xanthan gum, pullulan, and the like), as well as those materials in combination with materials such as ground cellulosics (e.g., fine particle size wood pulp). Preferred pouch materials, though water dispersible or dissolvable, may be designed and manufactured such that under conditions of normal use, a significant amount of the tobacco formulation contents permeate through the pouch material prior to the time that the pouch undergoes loss of its physical integrity. If desired, flavoring ingredients, disintegration aids, and other desired components, may be incorporated within, or applied to, the pouch material. In various embodiments, a nonwoven web can be used to form an outer water-permeable pouch which can be used to house a composition adapted for oral use.

The amount of material contained within each product unit, for example, a pouch, may vary. In some embodiments, the weight of the material within each pouch is at least about 50 mg, for example, from about 50 mg to about 1 gram, from about 100 to 800 about mg, or from about 200 to about 700 mg. In some smaller embodiments, the weight of the material within each pouch may be from about 100 to about 300 mg. For a larger embodiment, the weight of the material within each pouch may be from about 300 mg to about 700 mg. If desired, other components can be contained within each pouch. For example, at least one flavored strip, piece or sheet of flavored water dispersible or water soluble material (e.g., a breath-freshening edible film type of material) may be disposed within each pouch along with or without at least one capsule. Such strips or sheets may be folded or crumpled in order to be readily incorporated within the pouch. See, for example, the types of materials and technologies set forth in U.S. Pat. No. 6,887,307 to Scott et al. and U.S. Pat. No. 6,923,981 to Leung et al.; and The EFSA Journal (2004) 85, 1-32; which are incorporated herein by reference.

The smokeless tobacco product can be packaged within any suitable inner packaging material and/or outer container. See also, for example, the various types of containers for smokeless types of products that are set forth in U.S. Pat. No. 7,014,039 to Henson et al.; U.S. Pat. No. 7,537,110 to Kutsch et al.; U.S. Pat. No. 7,584,843 to Kutsch et al.; D592,956 to Thiellier; D594,154 to Patel et al.; and D625, 178 to Bailey et al.; US Pat. Pub. Nos. 2008/0173317 to Robinson et al.; 2009/0014343 to Clark et al.; 2009/0014450 to Bjorkholm; 2009/0250360 to Bellamah et al.; 2009/0266837 to Gelardi et al.; 2009/0223989 to Gelardi; 2009/0230003 to Thiellier; 2010/0084424 to Gelardi; and 2010/0133140 to Bailey et al; 2010/0264157 to Bailey et al.; 2011/0168712 to Bailey et al.; and 2011/0204074 to Gelardi et al., which are incorporated herein by reference.

Products of the present disclosure may be packaged and stored in much the same manner that conventional types of smokeless tobacco products are packaged and stored. For example, a plurality of packets or pouches may be contained in a container used to contain smokeless tobacco products, such as a cylindrical container sometimes referred to as a "puck". The container can be any shape, and is not limited to cylindrical containers. Such containers may be manufactured out of any suitable material, such as metal, molded plastic, fiberboard, combinations thereof, etc. If desired, moist tobacco products (e.g., products having moisture contents of more than about 20 weight percent) may be refrigerated (e.g., at a temperature of less than about 10° C., often less than about 8° C., and sometimes less than about 5° C.). Alternatively, relatively dry tobacco products (e.g., products having moisture contents of less than about 15 weight percent) often may be stored under a relatively wide range of temperatures.

Various smokeless tobacco products disclosed herein are advantageous in that they provide a composition that is non-staining, or is staining to a lesser degree than products comprising only unwhitened tobacco materials. These products thus are desirable in reducing staining of teeth and clothing that may come in contact therewith. It is noted that even the spent (used) product is lighter in color than traditional spent (used) oral tobacco products. Further, the products may have enhanced visual appeal by virtue of their whitened color.

The following examples are provided to further illustrate embodiments of the present disclosure, but should not be construed as limiting the scope thereof. Unless otherwise noted, all parts and percentages are by weight.

EXPERIMENTAL

Embodiments of the present disclosure are more fully illustrated by the following examples, which are set forth to illustrate aspects of the present disclosure and are not to be construed as limiting thereof. In the following examples, g means gram, L means liter, mL means milliliter, and Da means daltons. All weight percentages are expressed on a dry basis, meaning excluding water content, unless otherwise indicated.

Comparative Example 1

A comparison whitened tobacco material designated C1 was produced by a process involving tobacco material extraction, caustic extraction (i.e., chemical pulping), and then bleaching with hydrogen peroxide.

About 125 lbs. of milled *Rustica* stem was mixed with about 1125 lbs. of water and 0.7 lbs. EDTA. The slurry was agitated for about 1 hour at a temperature of 180° F. About 1 lbs. sodium hydroxide was added to the slurry. The slurry was discharged and the tobacco material was drained using a basket centrifuge.

The resulting tobacco material was caustically extracted: tobacco material was mixed with 1000 lbs. of water, about 58 lbs. sodium hydroxide, and 7.5 lbs. cellulose. The slurry was agitated for about 1 hour at a temperature of 200° F. After mixing, about 77.5 lbs. of citric acid was added to the slurry. The slurry was drained using a basket centrifuge. About 150 lbs. of water was used to rinse the caustically-extracted tobacco material.

Caustically-extracted tobacco material was subjected to a peroxide bleaching process: tobacco material was mixed with about 550 lbs. water, 41 lbs. sodium hydroxide, 12.5 lbs. 40% sodium silicate solution, 218 lbs. 30% hydrogen peroxide, and about 0.4 lbs. Xiameter AFE-0100 antifoam. The slurry was agitated for about 1 hour at a temperature of 165° F. The slurry was drained using a basket centrifuge. About 150 lbs. of water was used to rinse the tobacco material giving the bleached tobacco solid. The bleached tobacco solid was dried to a moisture content of about 10-15% moisture giving comparison bleached tobacco material C1. Table 1 below gives the whiteness and brightness values for dry bleached tobacco material C1. Whiteness (ASTM E313-73) and Brightness (ISO) values were determined using a Konica-Minolta CM-700d spectrophotometer and Spectramagic NX software. The brightness standard is listed as ISO 2470.

TABLE 1

| Comparison Material | Whiteness | Brightness |
|---|---|---|
| C1 | 15 | 52 |

Comparative Example 2

A comparison whitened tobacco material designated C2 was produced by the process described in Comparative Example 1 above. C2 had a whiteness of 24 and brightness 58. The freeness value of C2 was measured using TAPPI 2270M-99 and found to be 448. It is believed that C2 displayed improved whitening compared to C1 due to more efficient mixing during the treatment steps.

Example 1

Whitened tobacco materials were prepared according to the whitening procedures described herein.

About 125 lbs. of milled *Rustica* stem was mixed with about 1125 lbs. of water and 0.7 lbs. EDTA. The slurry was agitated for about 1 hour at a temperature of 180° F. About 1 lb sodium hydroxide was added to the slurry. The slurry was discharged and the tobacco material was drained using a basket centrifuge. The dewatered tobacco material collected was designated Q tobacco material.

Sample A1 was prepared by washing about 923 grams of Q tobacco material with five portions of 2.5 liters of water. The washed Q tobacco material was dewatered on a 300-micron mesh. The washed Q tobacco material was bleached with hydrogen peroxide: about 257 grams of moist washed Q tobacco material at about 82% moisture content was mixed with about 235 g water, 14 g 20% NaOH solution, 30.97 g 30% hydrogen peroxide, 1.88 g 10% sodium silicate solution, and 1.87 g 25% EDTA solution. The slurry was placed in a polyethylene bag heated on a hot water bath for 75 minutes reaching a temperature of about 80° C. The slurry was kneaded every 15 minutes. The peroxide bleached tobacco material was added to 1 liter water and dewatered on a 300-micron mesh and then washed with 2 liters of ambient temperature water. The bleached tobacco material was dried in a convection oven at 85° C. for about 12 hours.

Sample A2 was prepared by washing about 1100 grams of Q tobacco material with six portions of 2.5 liters of water. The washed Q tobacco material was dewatered on a 300-micron mesh. The washed Q tobacco material was bleached with hydrogen peroxide: about 308 grams of moist washed Q tobacco material at about 84% moisture content was mixed with about 140 g water, 15 g 20% NaOH solution, 125 g 30% hydrogen peroxide, 2.03 g 10% sodium silicate solution, and 2.03 g 25% EDTA solution. The slurry was placed in a polyethylene bag heated on a hot water bath for 75 minutes reaching a temperature of about 80° C. The slurry was kneaded every 15 minutes. The peroxide bleached tobacco material was added to 1 liter water and dewatered on a 300-micron mesh and then washed with 2 liters of 50° C. water. The bleached tobacco material was dried in a convection oven at 85° C. for about 12 hours.

About 125 lbs. of milled *Rustica* stem was mixed with about 1125 lbs. of water and 0.7 lb EDTA. The slurry was agitated for about 1 hour at a temperature of 180° F. About 1 lb sodium hydroxide was added to the slurry. The slurry was discharged and the tobacco material was drained using a basket centrifuge. The tobacco material was washed by directing 1500 lbs. of water through the tobacco material in the basket centrifuge. The dewatered tobacco material collected was designated QW tobacco material.

Sample A3 was prepared by bleaching QW tobacco material with hydrogen peroxide: about 228 grams of QW tobacco material at about 76% moisture content was mixed with about 1450 g water, 28 g 20% NaOH solution, 164 g 30% hydrogen peroxide, 2.19 g 10% sodium silicate solution, and 2.19 g 25% EDTA solution. The slurry agitated with an overhead mixer and heated at a temperature of about 80° C. for 75 minutes. The peroxide bleached tobacco material was dewatered on a 300-micron mesh and then washed with 3 liters of 50° C. water. The bleached tobacco material was dried in a convection oven at 85° C. for about 12 hours.

About 125 lbs. of milled *Rustica* stem was mixed with about 1125 lbs. of water and 0.7 lb EDTA. The slurry was agitated for about 1 hour at a temperature of 180° F. About 1 lb sodium hydroxide was added to the slurry. The slurry was discharged and the tobacco material was drained using a basket centrifuge. The dewatered tobacco material collected was designated Q2 tobacco material.

Sample A4 was prepared by bleaching Q2 tobacco material with hydrogen peroxide: about 199 grams of Q2 tobacco material at about 72% moisture content was mixed with about 1250 g water, 22 g 20% NaOH solution, 174 g 30% hydrogen peroxide, 2.30 g 10% sodium silicate solution, and 2.28 g 25% EDTA solution. The slurry agitated with an overhead mixer and heated at a temperature of about 80° C. for 75 minutes. The peroxide bleached tobacco material was dewatered on a 300-micron mesh and then washed with 0.4 liters of ambient water. The bleached tobacco material was dried in a convection oven at 85° C. for about 12 hours.

Table 2 lists inventive samples A1, A2, A3, and A4 prepared by the tobacco material whitening process described herein (i.e., without a caustic extraction step between the aqueous extraction and the bleaching steps). The tobacco whitening process according to the present disclosure achieves whiteness and brightness values which are comparable to those of comparison materials C1 and C2 (the comparison material process employing caustic extraction as described above).

TABLE 2

| Inventive Sample | Hydrogen Peroxide* | NaOH** | Hydrogen Peroxide/NaOH | Solids (%) | Start pH | End pH | Whiteness | Brightness |
|---|---|---|---|---|---|---|---|---|
| A1 | 20 | 6 | 3.3 | 9.6 | 10.73 | 8.77 | 1 | 51 |
| A2 | 74.8 | 6 | 12.5 | 10.0 | 9.82 | 8.23 | 14 | 57 |
| A3 | 90 | 10.1 | 8.9 | 3.0 | 9.63 | 9.48 | 17 | 58 |
| A4 | 94.7 | 8 | 11.8 | 3.5 | 9.33 | 7.96 | 20 | 60 |

*= 100 × 0.3 × g 30% hydrogen peroxide/g dry tobacco
**= 100 × g sodium hydroxide/g dry tobacco
Hydrogen Peroxide/NaOH = 0.30 × g 30% hydrogen peroxide/g sodium hydroxide
Solids (%) = 100 × (g dry tobacco)/(g dry tobacco + g water + g hydrogen peroxide)
Start pH = slurry pH at the beginning of the hydrogen peroxide bleaching step
End pH = slurry pH at the end of the hydrogen peroxide beaching step prior to dewatering It is noted that Whiteness (ASTM E313-73) and Brightness (ISO) values for samples A1-A4, samples B1-B4 in Example 2 below, and sample D1 in Example 3 below were determined using a Konica-Minolta CM-700d spectrophotometer and Spectramagic NX software. The brightness standard is listed as ISO 2470.

Example 2

Whitened tobacco materials were prepared according to the whitening procedures described herein.

Sample B1 was produced by using the inventive process involving tobacco material extraction and then bleaching with hydrogen peroxide. About 135 lbs. of milled *Rustica* stem was mixed with about 1217 lbs. of water and 0.74 lb EDTA. The slurry was agitated for about 1 hour at a temperature of 180° F. About 1.08 lb NaOH was added to the slurry. The slurry was discharged and the tobacco material was drained using a basket centrifuge.

The resulting tobacco material was subjected to a peroxide bleaching process: tobacco material was mixed with about 1177 lbs. water, 4.6 lbs. sodium hydroxide, 0.49 lbs. 40% sodium silicate solution, 0.49 lb EDTA, 179 lbs. 30% hydrogen peroxide, and about 0.16 lb Xiameter AFE-0100 antifoam. The slurry was agitated for about 1 hour at a temperature of 185° F. The slurry was drained using a basket centrifuge. About 300 lbs. of water was used to rinse the tobacco material giving the bleached tobacco solid. The bleached tobacco solid was dried to a moisture content of about 10-15% moisture giving comparison bleached tobacco material B1.

Sample B2 was produced by using the inventive process involving tobacco material extraction and then bleaching with hydrogen peroxide. About 135 lbs. of milled *Rustica* stem was mixed with about 1216 lbs. of water and 0.74 lb EDTA. The slurry was agitated for about 1 hour at a temperature of 180° F. About 1.08 lb NaOH was added to the slurry. The slurry was discharged and the tobacco material was drained using a basket centrifuge.

The resulting tobacco material was subjected to a peroxide bleaching process: tobacco material was mixed with about 1238 lbs. water, 6.70 lbs. sodium hydroxide, 0.51 lbs. 40% sodium silicate solution, 0.51 lb EDTA, 280 lbs. 30% hydrogen peroxide. The slurry was agitated for about 1 hour at a temperature of 185° F. During the agitation about 0.03 lb Xiameter AFE-0100 antifoam was added. The slurry was drained using a basket centrifuge. About 300 lbs. of water at about 140° F. temperature was used to rinse the tobacco material giving the bleached tobacco solid. The bleached tobacco solid was dried to a moisture content of about 10-15% moisture giving comparison bleached tobacco material B2.

Sample B3 was produced by using the inventive process involving tobacco material extraction and then bleaching with hydrogen peroxide. About 127.5 lbs. of milled *Rustica* stem and about 7.5 lbs. cellulose (unbleached softwood kraft material) were mixed with about 1216 lbs. of water and 0.74 lb EDTA. The slurry was agitated for about 1 hour at a temperature of 180° F. About 1.08 lb NaOH was added to the slurry. The slurry was discharged and the tobacco material was drained using a basket centrifuge. About 150 lbs. of water at ambient temperature was used to rinse the tobacco material in the basket centrifuge.

The resulting tobacco material was subjected to a peroxide bleaching process: tobacco material was mixed with about 1182 lbs. water, 7.10 lbs. sodium hydroxide, 0.70 lbs. 40% sodium silicate solution, 0.70 lb EDTA, 246 lbs. 30% hydrogen peroxide. The slurry was agitated for about 1 hour at a temperature of 185° F. The slurry was drained using a basket centrifuge. About 300 lbs. of water at ambient temperature was used to rinse the tobacco material giving the bleached tobacco solid. The bleached tobacco solid was dried to a moisture content of about 10-15% moisture giving comparison bleached tobacco material B3. The freeness of the fiber was measured as 611 CSF. The freeness value of B3 (and B4 below) was measured using TAPPI 2270M-99.

Sample B4 was produced by using the inventive process involving tobacco material extraction and then bleaching with hydrogen peroxide. About 135 lbs. of milled *Rustica* stem was mixed with about 1216 lbs. of water and 0.74 lb EDTA. The slurry was agitated for about 1 hour at a temperature of 180° F. About 1.08 lb NaOH was added to the slurry. The slurry was discharged and the tobacco material was drained using a basket centrifuge. About 150 lbs. of water at 140° F. temperature was used to rinse the tobacco material in the basket centrifuge.

The resulting tobacco material was subjected to a peroxide bleaching process: tobacco material was mixed with about 1177 lbs. water, 5.0 lbs. sodium hydroxide, 0.50 lbs. 40% sodium silicate solution, 0.49 lb EDTA, 178 lbs. 30% hydrogen peroxide. The slurry was agitated for about 1 hour at a temperature of 185° F. The slurry was drained using a basket centrifuge. About 300 lbs. of water at 140° F. temperature was used to rinse the tobacco material giving the bleached tobacco solid. The bleached tobacco solid was dried to a moisture content of about 10-15% moisture giving comparison bleached tobacco material B4. The freeness of the fiber was measured as 532 CSF.

Table 3 lists inventive samples B1, B2, B3, and B4, which were prepared by the tobacco material whitening process described herein without a caustic extraction step. The tobacco whitening process according to the present disclosure achieves whiteness and brightness values which are comparable to those of comparison materials C1 and C2 (the comparison material process employing caustic extraction as described above).

TABLE 3

| Inventive Sample | Hydrogen Peroxide/NaOH | Solids (%) | Start pH | End pH | Whiteness | Brightness |
|---|---|---|---|---|---|---|
| B1 | 11.7 | 3.2 | 9.07 | 7.99 | 12 | 57 |
| B2 | 12.6 | 3.1 | 9.44 | 8.66 | 14 | 56 |
| B3 | 10.4 | 4.5 | 9.88 | 8.78 | 13 | 54 |
| B4 | 10.7 | 4.0 | 9.25 | 8.00 | 10 | 55 |

Hydrogen Peroxide/NaOH = 0.30 × lbs. 30% hydrogen peroxide/lbs. sodium hydroxide
Solids (%) = 100 × (lbs. dry tobacco)/(lbs. dry tobacco + lbs. water + lbs. hydrogen peroxide)
Start pH = slurry pH at the beginning of the hydrogen peroxide bleaching step
End pH = slurry pH at the end of the hydrogen peroxide beaching step prior to dewatering Example 3

A whitened tobacco material was prepared according to the whitening procedures described herein.

Sample D1 was produced by using the inventive process involving tobacco material extraction and then bleaching with hydrogen peroxide. About 125 lbs. of milled *Rustica* stem was mixed with about 1125 lbs. of water and 0.7 lb EDTA. The slurry was agitated for about 1 hour at a temperature of 180° F. About 1 lb sodium hydroxide was added to the slurry. The slurry was discharged and the tobacco material was drained using a basket centrifuge.

About 1566 grams of the tobacco material, about 74% moisture content, was washed with five portions of 4 liters of ambient temperature water over a 300 micron mesh screen and the resulting fiber was designated QW2 tobacco material.

QW2 tobacco material was bleached with hydrogen peroxide: in a polyethylene bag about 418 grams of QW2 tobacco material at about 88% moisture content was mixed with about 85 g water, 30 g 10% NaOH solution, 25 g 30% hydrogen peroxide, 2.0 g 10% sodium silicate solution, and 2.0 g 25% EDTA solution. The slurry heated at a temperature of about 76° C. for 60 minutes. The peroxide bleached tobacco material was mixed with 1000 mL water, pH was adjusted to 6.68 with citric acid, then the slurry was dewatered on a 300-micron mesh and then washed with 1500 mL of ambient temperature water. The bleached tobacco material was designated QP.

QP tobacco material was bleached with hydrogen peroxide: in a polyethylene bag about 304 grams of QP tobacco material at about 90% moisture content was mixed with about 1.6 g water, 4.5 g 20% NaOH solution, 26 g 30% hydrogen peroxide, 1.2 g 10% sodium silicate solution, and 1.2 g 25% EDTA solution. The slurry heated at a temperature of about 75° C. for 45 minutes. The peroxide bleached tobacco material was mixed with 1000 mL water, pH was adjusted to 6.99 with citric acid, then the slurry was dewatered on a 300-micron mesh and then washed with 1500 mL of ambient temperature water. The bleached tobacco material was designated QPP. The bleached tobacco material QPP was dried in a convection oven at 85° C. for about 12 hours giving inventive example D1.

Table 4 lists inventive sample D1 prepared by the tobacco material whitening process described herein (i.e., without a caustic extraction step between the aqueous extraction and the bleaching steps). The tobacco whitening process according to the present disclosure achieves whiteness and brightness values which are comparable to those of comparison materials C1 and C2 (the comparison material process employing caustic extraction as described above).

TABLE 4

| Comparison Material | Whiteness | Brightness |
|---|---|---|
| D1 | 25 | 64 |

Many modifications and other embodiments will come to mind to one skilled in the art to which this disclosure pertains having the benefit of the teachings presented in the foregoing description. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed:

1. A method of preparing a whitened tobacco material, comprising:

(i) extracting a tobacco material with an extraction solution to provide a tobacco solids material and a tobacco extract, wherein the extracting of the tobacco material is done at a temperature of about 100° C. or below; and wherein the extraction solution is an aqueous solution comprising sodium hydroxide and a chelating agent;

(ii) bleaching the tobacco solids material with a bleaching solution comprising a strong base, an oxidizing agent, or a combination thereof to provide a bleached tobacco material; wherein the bleaching solution further comprises one or more stabilizers and/or a chelating agent; and (iii) drying the bleached tobacco material to provide the whitened tobacco material, wherein the tobacco solids material is not subjected to treatment at an elevated temperature with sulfur-containing reagents, organic solvents, sodium hydroxide, or an acid between the extracting of the tobacco material and the bleaching of the tobacco solids material.

2. The method of claim 1, further comprising milling the tobacco material to an average particle size in the range of approximately 0.2 mm to about 2 mm.

3. The method of claim 1, wherein the bleaching of the tobacco solids material is done at a temperature of about 100° C. or below.

4. The method of claim 1, wherein the bleached tobacco material is dried to a moisture content of less than about 30 percent moisture on a wet basis.

5. The method of claim 1, further comprising dewatering the tobacco material using at least one of a screw press and a basket centrifuge following extracting the tobacco material and/or bleaching the tobacco solids material.

6. The method of claim 1, wherein the bleaching solution comprises one or more of peracetic acid, sodium hydroxide, and hydrogen peroxide.

7. The method of claim 1, wherein the stabilizers are selected from the group consisting of magnesium sulfate, sodium silicate, and combinations thereof.

8. The method of claim 1, wherein the bleaching solution comprises a strong base and an oxidizing agent, and wherein the molar ratio of the amount of oxidizing agent to the amount of strong base is from about 1:1 to about 100:1.

9. The method of claim 8, wherein the weight ratio of the amount of oxidizing agent to the amount of strong base is from about 2.5:1 to about 15:1.

10. The method of claim 1, further comprising neutralizing the bleached tobacco material to a pH in the range of about 5 to about 11 prior to drying the bleached tobacco material.

11. The method of claim 1, further comprising milling the whitened tobacco material following the drying of the whitened tobacco material to an average particle size in the range of approximately 5 mm to about 0.1 mm.

12. The method of claim 1, wherein the chelating agent comprises one or more of EDTA and DTPA.

13. The method of claim 1, wherein the bleaching solution used to bleach the tobacco solids material comprises a chelating agent.

14. The method of claim 13, wherein the chelating agent comprises one or more of EDTA and DTPA.

15. The method of claim 1, wherein the molar ratio of the extraction solution to the tobacco material is from about 4:1 to about 16:1.

16. The method of claim 1, wherein the extraction solution is an aqueous solution.

17. The method of claim 1, wherein the tobacco material comprises lamina, stems, or a combination thereof.

18. The method of claim 1, wherein the tobacco material comprises Rustica stems.

19. The method of claim 1, wherein the tobacco material comprises at least about 90% by weight roots, stalks, or a combination thereof.

20. The method of claim 1, wherein the whitened tobacco material is characterized by an International Organization for Standardization (ISO) brightness of at least about 50%.

21. The method of claim 1, further comprising mixing the tobacco solids material with a wood pulp prior to bleaching the tobacco solids material.

22. The method of claim 1, further comprising incorporating the whitened tobacco material within a smokeless tobacco product.

23. The method of claim 22, wherein the smokeless tobacco product further comprises one or more additional components selected from the group consisting of flavorants, fillers, binders, pH adjusters, buffering agents, colorants, disintegration aids, antioxidants, humectants, and preservatives.

* * * * *